US008043018B2

(12) United States Patent
Cheng

(10) Patent No.: US 8,043,018 B2
(45) Date of Patent: Oct. 25, 2011

(54) RING BINDER MECHANISM

(75) Inventor: Hung Yu Cheng, Hong Kong (CN)

(73) Assignee: World Wide Stationery Manufacturing Co., Ltd., Kwai Chung, New Territory (HK)

( * ) Notice: Subject to any disclaimer, the term of this patent is extended or adjusted under 35 U.S.C. 154(b) by 0 days.

(21) Appl. No.: 12/837,075

(22) Filed: Jul. 15, 2010

(65) Prior Publication Data

US 2010/0278583 A1 Nov. 4, 2010

Related U.S. Application Data

(63) Continuation of application No. 12/171,919, filed on Jul. 11, 2008, now Pat. No. 7,762,734, which is a continuation of application No. 11/027,550, filed on Dec. 30, 2004, now Pat. No. 7,404,685.

(51) Int. Cl.
*B42F 13/20* (2006.01)

(52) U.S. Cl. ..... 402/31; 402/26; 402/41; 402/42; 402/73

(58) Field of Classification Search ..... 402/19, 402/73, 38, 41, 31, 42, 26
See application file for complete search history.

(56) References Cited

U.S. PATENT DOCUMENTS

| | | | |
|---|---|---|---|
| 0,566,717 | A | 8/1896 | Krah |
| 0,651,254 | A | 6/1900 | Krah |
| 0,683,019 | A | 9/1901 | Buchanan |
| 0,790,382 | A | 5/1905 | McBride |
| 0,854,074 | A | 5/1907 | Bryant |
| 0,857,377 | A | 6/1907 | Baker |
| 0,974,831 | A | 11/1910 | Scherzinger |
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |

(Continued)

FOREIGN PATENT DOCUMENTS

EP 1431065 A2 6/2004

(Continued)

OTHER PUBLICATIONS

Response filed Mar. 11, 2008 to Office action issued Dec. 13, 2007 in U.S. Appl. No. 11/027,550, 10 pgs.

(Continued)

*Primary Examiner* — Dana Ross
*Assistant Examiner* — Matthew G Katcoff
(74) *Attorney, Agent, or Firm* — Senniger Powers LLP

(57) ABSTRACT

A ring binder mechanism has a housing supporting first and second hinge plates and rings, each ring including first and second ring members. The first ring member is mounted one of the hinge plates and moveable with the hinge plate relative to the second ring member between closed and open positions. An actuating lever for opening the rings is mounted on a pin secured to the housing. Pivoting of the actuator moves a travel bar relative to the hinge plates. A blocking element is secured to the travel bar for conjoint movement therewith between a locking position in which the blocking element blocks pivoting movement of the hinge plates to open the rings and a non-locking position in which the blocking element does not block pivoting movement of the hinge plates to open the rings. A torsion spring on the pin biases the actuating lever to its closed position.

23 Claims, 33 Drawing Sheets

U.S. PATENT DOCUMENTS 1,598,206 A 8/1926 Lindstedt et al.
1,733,548 A 10/1929 Martin
1,733,894 A 10/1929 Martin
1,787,957 A 1/1931 Schade
1,822,669 A 9/1931 Schade
1,824,791 A 9/1931 Rengmann
1,857,291 A 5/1932 Trussell
1,896,839 A 2/1933 Dawson
1,953,981 A 4/1934 Trussell
1,991,362 A 2/1935 Krag
1,996,463 A 4/1935 Dawson et al.
2,004,570 A 6/1935 Dawson
2,013,416 A 9/1935 McClure
2,024,461 A 12/1935 Lotter
2,067,846 A 1/1937 Cooper
2,075,766 A 3/1937 Rand
2,089,211 A 8/1937 Krag
2,096,944 A 10/1937 Unger et al.
2,103,307 A 12/1937 Unger
2,105,235 A 1/1938 Schade
2,158,056 A 5/1939 Cruzan
2,179,627 A 11/1939 Handler
2,204,918 A 6/1940 Trussell
2,218,105 A 10/1940 Griffin
2,236,321 A 3/1941 Ostrander
2,239,062 A 4/1941 Tallmadge
2,239,121 A 4/1941 St. Louis et al.
2,251,878 A 8/1941 Hanna et al.
2,252,422 A 8/1941 Unger
2,260,929 A 10/1941 Bloore
2,288,189 A 6/1942 Guinane
2,304,716 A 12/1942 Supin
2,311,492 A 2/1943 Unger
2,322,595 A 6/1943 Schade
2,338,011 A 12/1943 Schade
2,421,799 A 6/1947 Martin
2,528,866 A 11/1950 Dawson, Jr.
2,543,866 A 3/1951 Panfil, Sr.
2,552,076 A 5/1951 Wedge
2,612,169 A 9/1952 Segal
2,789,561 A 4/1957 Bonn et al.
2,865,377 A 12/1958 Schroer et al.
2,871,711 A 2/1959 Stark
2,891,553 A 6/1959 Acton
2,894,513 A 7/1959 Gempe et al.
2,950,719 A 8/1960 Lyon
3,077,888 A 2/1963 Thieme
3,098,489 A 7/1963 Vernon
3,098,490 A 7/1963 Wance
3,101,719 A 8/1963 Vernon
3,104,667 A 9/1963 Mintz
3,149,636 A 9/1964 Rankin
3,190,293 A 6/1965 Schneider et al.
3,205,894 A 9/1965 Rankin
3,205,895 A 9/1965 Johnson
3,255,759 A 6/1966 Dennis
3,348,550 A 10/1967 Wolf et al.
3,718,402 A 2/1973 Schade
3,748,051 A 7/1973 Frank
3,884,586 A 5/1975 Michaelis et al.
3,954,343 A 5/1976 Thomsen
3,993,374 A 11/1976 Schudy et al.
4,127,340 A 11/1978 Almgren
4,130,368 A 12/1978 Jacoby et al.
4,222,679 A 9/1980 Luogameno
4,352,582 A 10/1982 Eliasson
4,486,112 A 12/1984 Cummins
4,522,526 A 6/1985 Lozfau et al.
4,566,817 A 1/1986 Barrett, Jr.
4,571,108 A 2/1986 Vogl
4,696,595 A 9/1987 Pinkney
4,798,491 A 1/1989 Lassle
4,813,803 A 3/1989 Gross
4,815,882 A 3/1989 Ohminato
4,886,390 A 12/1989 Silence et al.
4,919,557 A 4/1990 Podosek
5,067,840 A 11/1991 Cooper et al.
5,116,157 A 5/1992 Gillum et al.
5,135,323 A 8/1992 Pinheiro
5,180,247 A 1/1993 Yu
5,255,991 A 10/1993 Sparkes
5,286,128 A 2/1994 Gillum
5,332,327 A 7/1994 Gillum
5,346,325 A 9/1994 Yamanoi
5,354,142 A 10/1994 Yu
5,368,407 A 11/1994 Law
5,378,073 A 1/1995 Law
5,393,155 A 2/1995 Ng
5,393,156 A 2/1995 Mullin et al.
5,476,335 A 12/1995 Whaley
5,524,997 A 6/1996 von Rohrscheidt
5,577,852 A 11/1996 To
5,651,628 A 7/1997 Bankes et al.
5,660,490 A 8/1997 Warrington
5,692,847 A 12/1997 Zane et al.
5,692,848 A 12/1997 Wada
5,718,529 A 2/1998 Chan
5,782,569 A 7/1998 Mullin et al.
5,788,392 A 8/1998 Cheung
5,807,006 A 9/1998 Cheung
5,810,499 A 9/1998 Law
5,816,729 A 10/1998 Whaley
5,836,709 A 11/1998 Cheung
5,868,513 A 2/1999 Law
5,879,097 A 3/1999 Cheng
5,882,135 A 3/1999 Ko
5,895,164 A 4/1999 Wu
5,904,435 A 5/1999 Tung
5,924,811 A 7/1999 To et al.
5,957,611 A 9/1999 Whaley
5,975,785 A 11/1999 Chan
6,036,394 A 3/2000 Cheng
6,142,697 A 11/2000 Williams
6,146,042 A 11/2000 To et al.
6,155,737 A 12/2000 Whaley
6,203,229 B1 3/2001 Coerver
6,206,601 B1 3/2001 Ko
6,217,247 B1 4/2001 Ng
6,270,279 B1 8/2001 Whaley
6,276,862 B1 * 8/2001 Snyder et al. ..... 402/40
6,293,722 B1 9/2001 Holbrook et al.
6,364,558 B1 4/2002 To
6,371,678 B1 4/2002 Chizmar
6,467,984 B1 10/2002 To
6,474,897 B1 11/2002 To
6,533,486 B1 3/2003 To
6,749,357 B2 6/2004 Cheng
6,758,621 B2 7/2004 To
6,821,045 B2 11/2004 Whaley
6,840,695 B2 1/2005 Horn
6,916,134 B2 7/2005 Wong
7,223,040 B2 5/2007 Koike et al.
7,270,496 B2 9/2007 Morgan et al.
7,275,886 B2 10/2007 Cheng
7,296,946 B2 11/2007 Cheng et al.
7,404,685 B2 7/2008 Cheng
7,530,755 B2 5/2009 Whaley
7,549,817 B2 6/2009 Cheng et al.
7,661,898 B2 2/2010 Ng et al.
2003/0044221 A1 3/2003 To et al.
2003/0103797 A1 * 6/2003 Cheng ..... 402/73
2005/0201818 A1 9/2005 Cheng
2006/0008318 A1 1/2006 Ng
2006/0147254 A1 7/2006 Cheng et al.

FOREIGN PATENT DOCUMENTS

FR 1336765 A 9/1963
FR 1346864 A 12/1963
FR 2221924 10/1974
FR 2238332 A5 2/1975
GB 868724 A 5/1961
GB 906279 A 9/1962
GB 952536 A 3/1964
GB 2231536 A 11/1990
GB 2275023 A 8/1994
GB 2292343 A 2/1996
GB 2387815 A 10/2003

| | | | |
|---|---|---|---|
| JP | 5979379 | U | 5/1984 |
| JP | 6118880 | U | 2/1986 |
| JP | 1299095 | A | 12/1989 |
| JP | 2034289 | U | 3/1990 |
| JP | 4120085 | U | 10/1992 |
| JP | 10-217662 | A | 8/1998 |
| JP | 200118573 | A | 1/2001 |
| JP | 2004098417 | A | 4/2004 |

OTHER PUBLICATIONS

Office action dated Mar. 25, 2009 from U.S. Appl. No. 12/171,919, 11 pages.
Response filed Dec. 21, 2009 to Office action issued Sep. 21, 2009 in U.S. Appl. No. 12/171,919, 18 pgs.
Response filed Apr. 25, 2008 to Office action issued Jan. 2, 2008 in U.S. Appl. No. 11/371,605, 11 pgs.
Kokuyo Lock Ring Mechanism with description, two instruction sheets, and nine photographs, undated but admitted as prior art, 12 pgs.
Office action dated Dec. 13, 2007 from U.S. Appl. No. 11/027,550, 10 pgs.
Response filed Mar. 11, 2008 to Office action issued Dec. 13, 2007 in U.S. Appl. No. 11/027,550, 10 pgs.
Office action dated Mar. 25, 2009 from U.S. Appl. No. 12/171,919, 10 pages.
Response filed Jun. 4, 2009 to Office action issued Mar. 25, 2009 in U.S. Appl. No. 12/171,919, 11 pgs.
Office action dated Sep. 21, 2009 from U.S. Appl. No. 12/171,919, 11 pgs.
Response filed Dec. 21, 2009 to Office action issued Sep. 21, 2009 in U.S. Appl. No. 12/171,919, 18 pgs.
Office action dated Jan. 2, 2008 from U.S. Appl. No. 11/371,605, 15 pgs.
Response filed Apr. 25, 2008 to Office action issued Jan. 2, 2008 in U.S. Appl. No. 11/371,605, 11 pgs.
Office action dated Sep. 2, 2008 from U.S. Appl. No. 11/371,605, 10 pgs.
Response filed Nov. 26, 2008 to Office action issued Sep. 2, 2008 in U.S. Appl. No. 11/371,605, 7 pgs.
Office action dated Apr. 16, 2008 in U.S. Appl. No. 11/157,620, 13 pgs.
Response filed Jul. 14, 2008 to Office action issued Apr. 16, 2008 in U.S. Appl. No. 11/157,620, 12 pgs.
Office action dated Oct. 23, 2008 in U.S. Appl. No. 11/157,620, 14 pgs.
Response filed Feb. 23, 2009 to Office action issued Oct. 23, 2008 in U.S. Appl. No. 11/157,620, 15 pgs.
Office action dated May 15, 2009 in U.S. Appl. No. 11/157,620, 10 pgs.
"Joint Memorandum in Support of Motion for Claim Construction by the Court Regarding U.S. Patent No. 7,404,685" from litigation concerning related U.S. Patent 7,404,685, filed Sep. 17, 2008, 517 pages.
"Defendant U.S. Ring Binder, L.P.'s Response to Plaintiffs Proposed Claim Constructions Regarding U.S. Patent No. 7,404,685" from litigation concerning related U.S. Patent 7,404,685, filed Oct. 3, 2008, 26 pages.
"Plaintiff World Wide Stationery Manufacturing Co. Ltd.'s Response to Defendant's Proposed Claim Construction of U.S. Patent No. 7,404,685" from litigation concerning related U.S. Patent 7,404,685, filed Oct. 3, 2008, 123 pages.
"Markman Hearing Transcript" [transcript of "Markman Hearing"] from litigation concerning related U.S. Patent 7,404,685, dated Nov. 4, 2008, 148 pages.
"Plaintiffs Post-Hearing Claim Construction Brief" from litigation concerning related U.S. Patent 7,404,685, filed Nov. 25, 2008, 640 pages.
"Defendant U.S. Ring Binder, L.P.'s Supplemental Brief Regarding Claim Construction" from litigation concerning related U.S. Patent 7,404,685, filed Nov. 25, 2008, 177 pages.
" List of Disputed and Non-Disputed Claim Terms" from litigation concerning related U.S. Patent 7,404,685, filed Nov. 25, 2008, 3 pags.
"Opening Expert Report of Dr. Virgil J. Flanigan" from litigation concerning related U.S. Patent 7,404,685, dated Feb. 13, 2009, 175 pages.
"Expert Witness Report of Jeffrey K. Ball, Ph.D., P.E." from litigation concerning related U.S. Patent 7,404,685, dated Feb. 13, 2009, 166 pages.
"Defendant U.S. Ring Binder LP's Motion, Statement of Undisputed Material Facts, and Memorandum in Support of Motion for Summary Judgment of Non-Infringement of U.S. Patent No. 7,296,946" from litigation concerning related U.S. Patent 7,404,685, filed Mar. 5, 2009, 95 pages.
"Memorandum And Order" from litigation concerning related U.S. Patent 7,404,685, filed Mar. 31, 2009, 39 pages.
"Supplemental Report Of Jeffrey K. Ball, Ph.D., P.E." from litigation concerning related U.S. Patent 7,404,685, dated Apr. 9, 2009, 6 pages.
"Expert Witness Report of Jeffrey K. Ball, Ph.D., P.E." from litigation concerning related U.S. Patent 7,404,685, dated Apr. 10, 2009, 53 pages.
"Defendant's Supplemental Motion for Summary Judgment of Non-Infringment of U.S. Patent No. 7,296,946 and U.S. Patent No. 7,404,685" from litigation concerning related U.S. Patent 7,404,685, filed Apr. 14, 2009, 176 pages.
"Statement of Uncontroverted Material Facts in Support of Plaintiffs Motion for Partial Summary Judgment on the Issue of Infringement of U.S. Patent No. 7,404,685" from litigation concerning related U.S. Patent 7,404,685, filed Apr. 14, 2009, 126 pages.
"Motion For Summary Judgment Of Non-Infringement Of U.S. Patent No. 7,296,946 And Motion For Summary Judgment Of Invalidity Of U.S. Patent No. 7,296,946 Based On Improper Inventorship" from litigation concerning related U.S. Patent 7,404,685, filed Apr. 14, 2009, 2 pages.
"Plaintiffs Motion For Partial Summary Judgment on the Issue of Infringement of U.S. Patent No. 7,404,685" from litigation concerning related U.S. Patent 7,404,685, filed Apr. 14, 2009, 3 pages.
"Memorandum In Support Of Plaintiffs Motion For Partial Summary Judgment On The Issue Of Infringement Of U.S. Patent No. 7,404,685" from litigation concerning related U.S. Patent 7,404,685, filed Apr. 14, 2009, 14 pages.
"Plaintiffs Response to Defendant's Statement of Undisputed Material Facts in Support of Motion for Summary Judgment of Non-Infringement of U.S. Patent No. 7,296,946 and Plaintiffs Statement of Additional Material Facts" from litigation concerning related U.S. Patent 7,404,685, filed Apr. 20, 2009, 9 pages.
"Supplemental Report Of Jeffrey K. Ball, Ph.D., P.E." from litigation concerning related U.S. Patent 7,404,685, dated Apr. 20, 2009, 6 pages.
"Memorandum in Opposition to Plaintiff's Motion for Partial Summary Judgment on the Issue of Infringement of U.S. Patent No. 7,404,685" from litigation concerning related U.S. Patent 7,404,685, filed Apr. 20, 2009, 18 pages.
"Plaintiffs Response In Opposition To Defendant's Motion For Summary Judgment Of Non-Infringement Of U.S. Patent No. 7.296,946" from litigation concerning related U.S. Patent 7,404,685, filed Apr. 20, 2009, 5 pp.
"Supplemental Expert Report of Dr. Virgil J. Flanigan" from litigation concerning related U.S. Patent 7,404,685, dated Apr. 23, 2009, 19 pages.
"U.S. Ring Binder LP's Reply Brief In Support Of Its Motions For Summary Judgment Of Non-Infringement of U.S. Patent No. 7,296,946 and U.S. Patent No. 7,404,685" from litigation concerning related U.S. Patent 7,404,685, filed Apr. 27, 2009, 4 pages.
"Reply Memorandum In Support Of Plaintiffs Motion For Partial Summary Judgment On The Issue Of Infringement of U.S. Patent No. 7,404,685" from litigation concerning related U.S. Patent 7,404,685, filed Apr. 27, 2009, 10 pages.
"Rebuttal Report Of Dr. Virgil J. Flanigan In Response To The Expert Report, Declaration and Supplemental Report Of Jeffrey K. Ball" from litigation concerning related U.S. Patent 7,404,685, dated May 1, 2009, 10 pages.
"Memorandum In Support Of Plaintiffs Motion For Reconsideration Of The Court's Claim Construction Ruling" from litigation concerning related U.S. Patent 7,404,685, filed Jul. 13, 2009, 16 pages.

"Amended Memorandum and Order" from litigation concerning related U.S. Patent 7,404,685, filed Sep. 14, 2009, 33 pages.
"Expert Witness Report on Invalidity Of Jeffrey K. Ball, Ph.D., P.E." from *U.S. Ring Binder, L.P.* v. *Staples The Office Superstore LLC, et al.*, dated Sep. 29, 2009, 39 pages.
"Verdict Form" —from litigation concerning related U.S. Patent Nos. 7,296,946 and 7,404,685, Case No. 4:07CV1947 CEJ, 18 pages. Document 328. Dated Nov. 29, 2010.
" Brief of Plaintiff-Appellant" —U.S. Court of Appeals for the Fed Cir, Case No. 2010-1358, -1359 (concerning related U. S. Patent Nos. 7,296,946 and 7,404,685), 175 pages. Dated Aug. 2, 2010.
"Brief of Defendant-Cross Appellant U.S. Ring Binder, L.P." - U.S. Court of Appeals for the Fed Cir, Case No. 2010-1358, -1359 (concerning related U.S. Patent Nos. 7,296,946 and 7,404,685), 172 pages. Dated Sep. 16, 2010.
"Reply Brief of Plaintiff-Appellant World Wide Stationery Manufacturing Co., Ltd." —U.S. Court of Appeals for the Fed Cir, Case No. 2010-1358, -1359 (concerning related U.S. Patent Nos. 7,296,946 and 7,404,685), 69 pages. Dated Oct. 29, 2010.
"Reply Brief of Cross Appellant U.S. Ring Binder, L.P." —U.S. Court of Appeals for the Fed Cir, Case No. 2010-1358, -1359 (concerning related U.S. Patent Nos. 7,296,946 and 7,404,685), 16 pages. Dated Nov. 15, 2010.
"Notice of Entry of Judgment Without Opinion", U.S. Court of Appeals for the Fed Cir, Case No. 2010-1358, -1359 (concerning related U.S. Patent Nos. 7,296,946 and 7,404,685), 4 pages. Document 392, Dated May 5, 2011.

* cited by examiner

RING BINDER MECHANISM

CROSS-REFERENCE TO RELATED APPLICATION

This application is a continuation application of U.S. patent application Ser. No. 12/171,919 filed Jul. 11, 2008, which is to be issued Jul. 27, 2010 as U.S. Pat. No. 7,762,734 and which is a continuation of U.S. patent application Ser. No. 11/027,550 filed Dec. 30, 2004, now U.S. Pat. No. 7,404,685, titled Ring Binder Mechanism Spring Biased to a Locked Position when Ring Members Close, the entire disclosures of which are hereby incorporated by reference.

BACKGROUND OF THE INVENTION

The present invention generally relates to a ring binder mechanism for retaining loose-leaf pages, and in particular to an improved mechanism for opening and closing ring members and for readily and securely locking closed ring members together.

A ring binder mechanism retains loose-leaf pages, such as hole-punched pages, in a file or notebook. It has ring members for retaining the pages. The ring members may be selectively opened to add or remove pages or closed to retain pages while allowing them to be moved along the ring members. The ring members mount on two adjacent hinge plates that join together about a pivot axis for pivoting movement within an elongated housing. The housing loosely holds the hinge plates so they may pivot relative to the housing. The undeformed housing is slightly narrower than the joined hinge plates when the hinge plates are in a coplanar position (180°). So as the hinge plates pivot through this position, they deform the resilient housing and cause a spring force in the housing urging the hinge plates to pivot away from the coplanar position either opening or closing the ring members. Thus, when the ring members are closed the spring force resists hinge plate movement and clamps the ring members together. Similarly, when the ring members are open, the spring force holds them apart. An operator may typically overcome this force by manually pulling the ring members apart or pushing them together. Levers may also be provided on both ends of the binder for moving the ring members between the open and closed positions.

One drawback to these typical ring binder mechanisms is that when the ring members close, the housing's spring force snaps them together rapidly and with a force that might cause fingers to be pinched between the ring members. The substantial spring force required to keep the ring members closed also makes pivoting the hinge plates through the coplanar position (180°) difficult so that it is hard to both open and close the ring members. Another drawback is that when the ring members are closed, they do not positively lock together. So if the mechanism is accidentally dropped, the ring members may unintentionally open. Still another drawback is that over time the housing may begin to permanently deform, reducing its ability to uniformly clamp the ring members together and possibly causing uneven movements or gaps between closed ring members.

To address these concerns, some ring binder mechanisms include a control slide attached directly to the lever. These control slides have inclined cam surfaces that project through openings in the hinge plates for rigidly controlling the hinge plates' pivoting motion both when opening and closing the ring members. Examples of these types of mechanisms are shown in U.S. Pat. Nos. 4,566,817, 4,571,108, and 6,276,862 and in U.K. Pat. No. 2,292,343. Some of these cam surfaces have a stop for blocking the hinge plates' pivoting motion when the ring members are closed and for locking the closed ring members together. These mechanisms require the operator to move the lever to lock the rings closed. The operator must manually move the lever to move the control slide stops into position to block the hinge plates from pivoting. Failure to do this could result in the rings inadvertently opening and pages falling out. Any solution to this issue should be made so as to keep the construction simple and economic, and avoid causing the rings to snap closed.

Accordingly, there is a need for an efficient ring binder mechanism that readily locks when ring members close for retaining loose-leaf pages and has ring members that easily open and close.

SUMMARY OF THE INVENTION

In one aspect of the present invention a ring binder mechanism for retaining loose-leaf pages generally comprises a housing and hinge plates supported by the housing for pivoting motion relative to the housing. Rings for holding the loose-leaf pages each include a first ring member and a second ring member. The first ring member is mounted on the first hinge plate and moveable with the pivoting motion of the first hinge plate relative to the second ring member between a closed position and an open position. In the closed position the first and second ring members form a substantially continuous closed loop. In the open position the first and second ring members form a discontinuous open loop. A pin is secured to the housing. An actuating lever is mounted on the pin for pivoting movement relative to the housing from a first position to a second position to open the rings. A travel bar is operatively connected to the actuator so the pivoting movement of the actuator produces longitudinal movement of the travel bar relative to the hinge plates. A blocking element is secured to the travel bar for conjoint movement with the travel bar between a locking position in which the blocking element blocks pivoting movement of the hinge plates to open the rings and a non-locking position in which the blocking element does not block pivoting movement of the hinge plates to open the rings. A torsion spring is received on the pin and positioned to bias the actuating lever to its first position.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
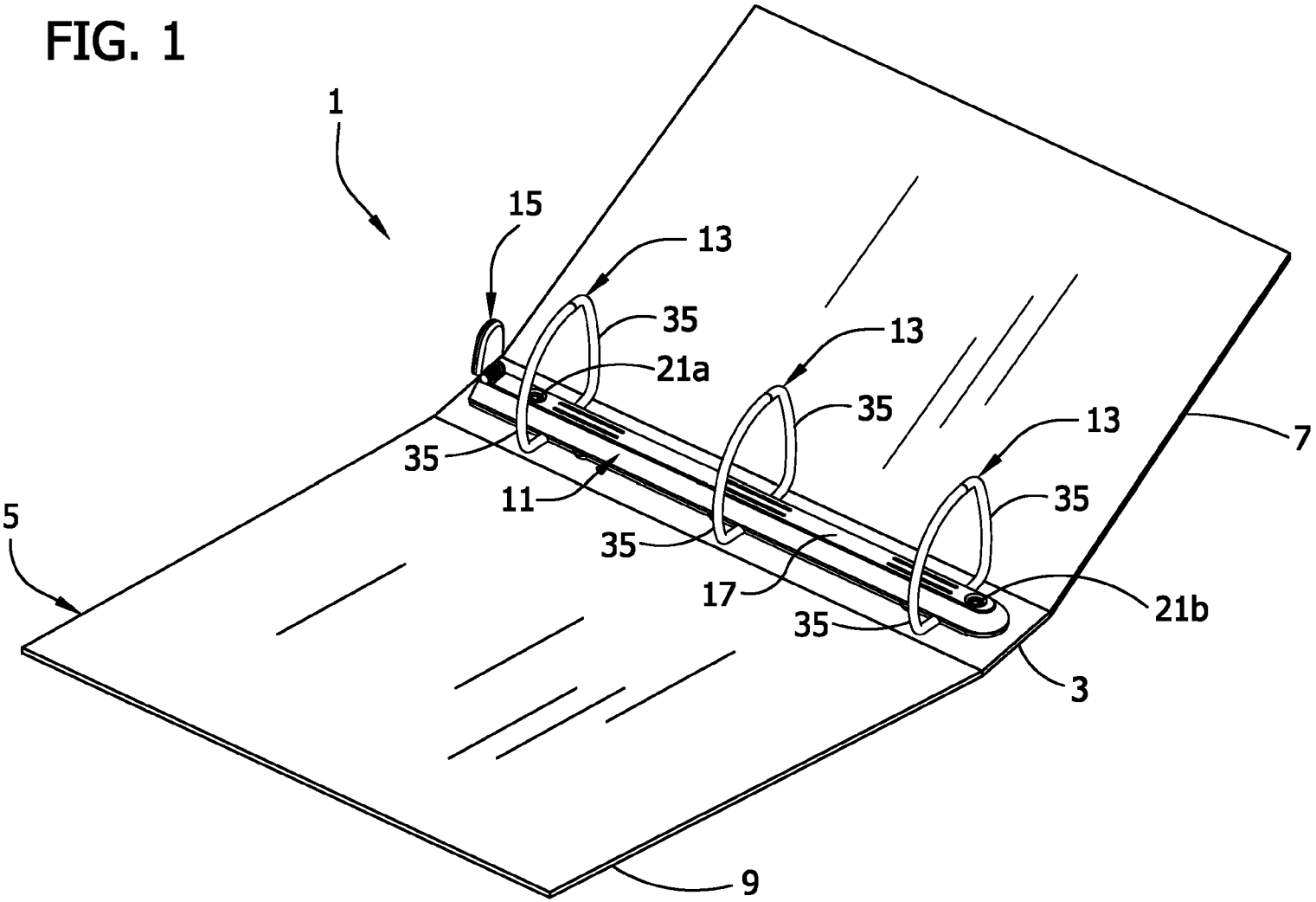
FIG. 1 is a perspective of a notebook incorporating a ring binder mechanism according to a first embodiment of the invention.

Referring now to the drawings and in particular to FIG. 1, a ring binder mechanism according to a first embodiment of the invention for retaining loose-leaf pages (the pages are not shown in the drawings) is indicated generally at reference numeral 1. The mechanism 1 is shown mounted on a spine 3 of a notebook (the notebook being indicated generally at reference numeral 5) having a front cover 7 and a back cover 9 hingedly attached to the spine. The front and back covers 7 and 9 move to selectively cover or expose retained pages. Ring binder mechanisms mounted on surfaces other than a notebook, however, do not depart from the scope of this invention.

Figure 2:
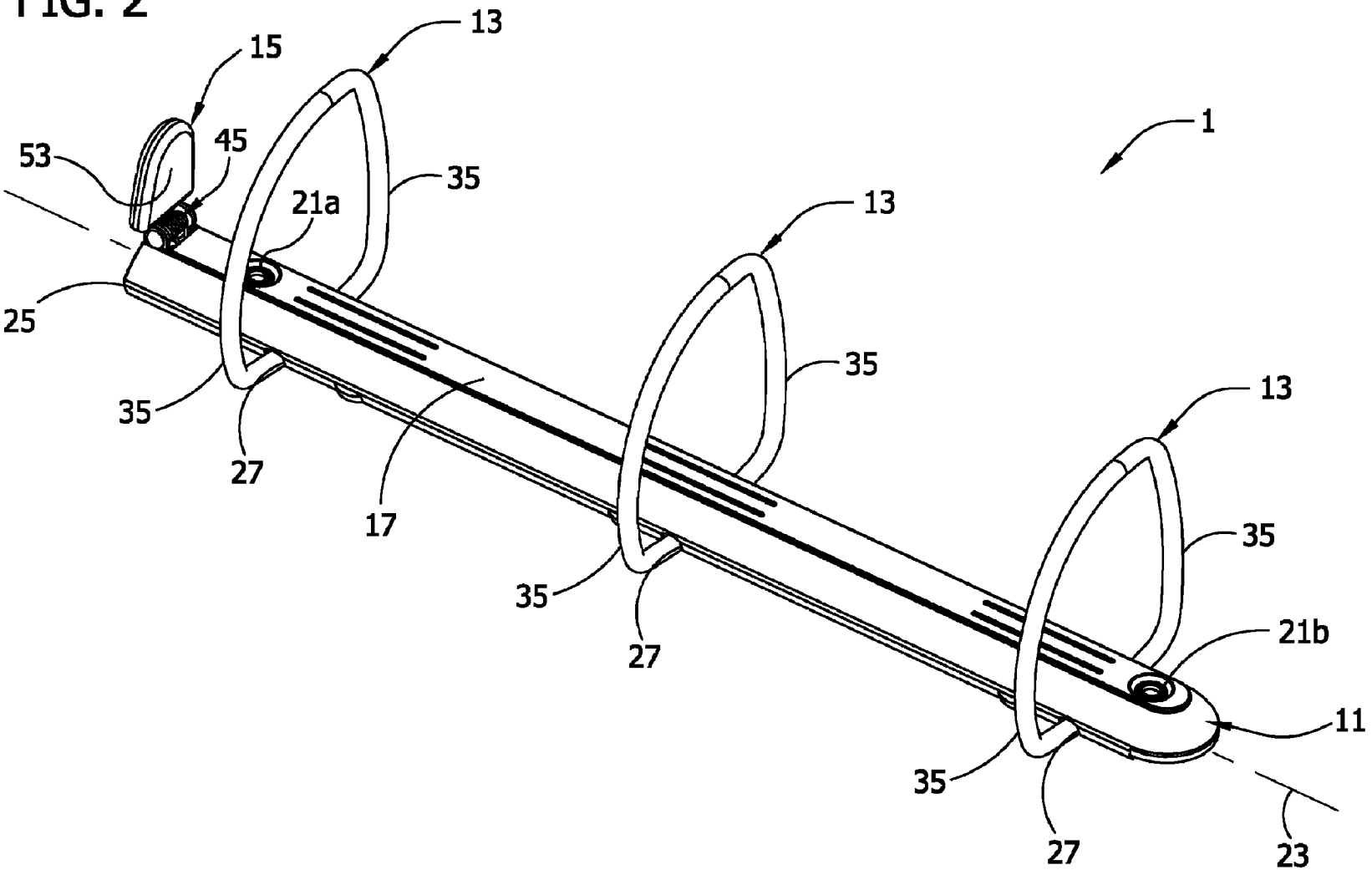
FIG. 2 is a perspective of the ring binder mechanism shown in FIG. 1 at a closed and locked position.
Figure 3:
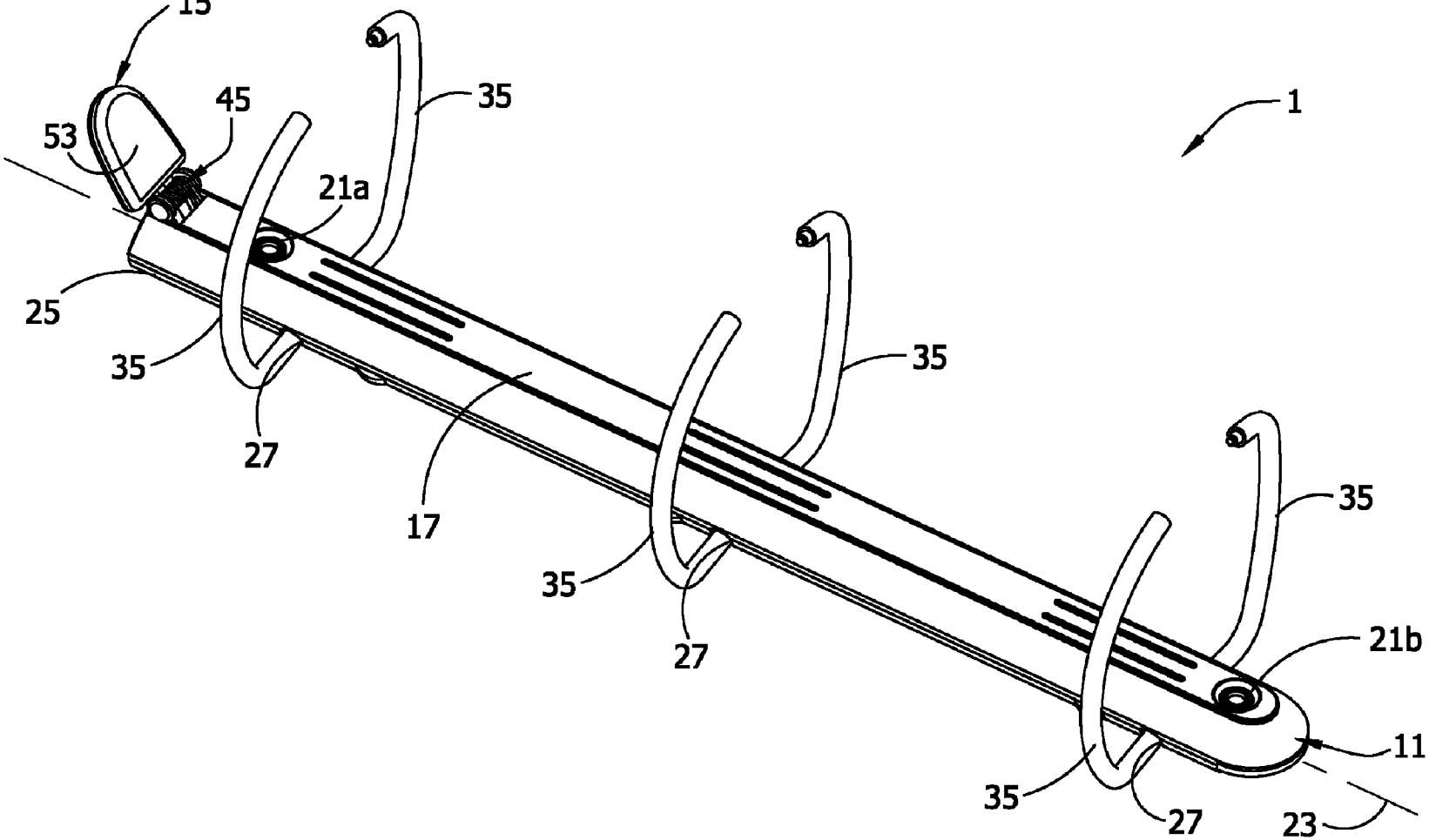
FIG. 3 is a perspective similar to FIG. 2 with the mechanism at an open position.

As shown in FIGS. 2 and 3, the mechanism 1 includes an elongate plate, also termed a housing and indicated generally at reference numeral 11, supporting three rings, each indicated generally at reference numeral 13 (FIG. 2). A lever (broadly, "an actuator"), designated generally at reference numeral 15, is pivotally mounted on a first longitudinal end of the housing 11 for moving the rings 13 between a closed position (FIG. 2) in which loose-leaf pages are retained on the rings and an open position (FIG. 3) in which loose-leaf pages (the loose-leaf pages are not shown in the drawings) may be added or removed, as will be described in greater detail hereinafter. The lever 15 is also movable to lock the rings 13 in the closed position as will be described in greater detail hereinafter. In the illustrated mechanism 1, a second longitudinal end of the housing 11 has no actuating lever. But it is understood that a mechanism having an actuating lever at both ends of a housing does not depart from the scope of the invention. Moreover, actuators other than levers (e.g., a push button) could be used within the scope of the invention. Further, a mechanism with a different number of rings, greater or fewer than three, does not depart from the scope of this invention. Still further, the ring mechanism of the invention may be used by itself with supporting structure other than a notebook.

Figure 4:
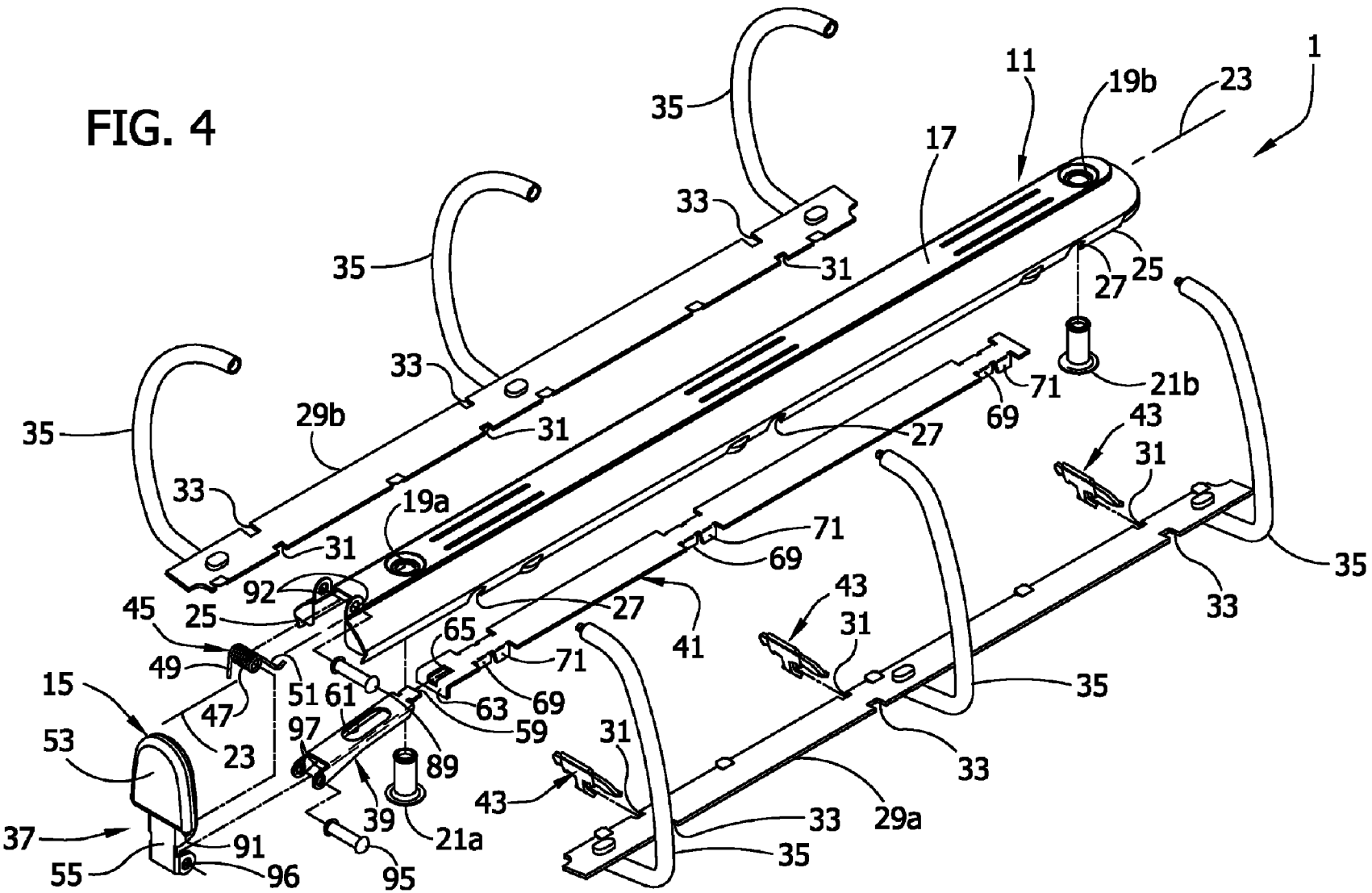
FIG. 4 is an exploded perspective of the ring binder mechanism.
Figure 8A:
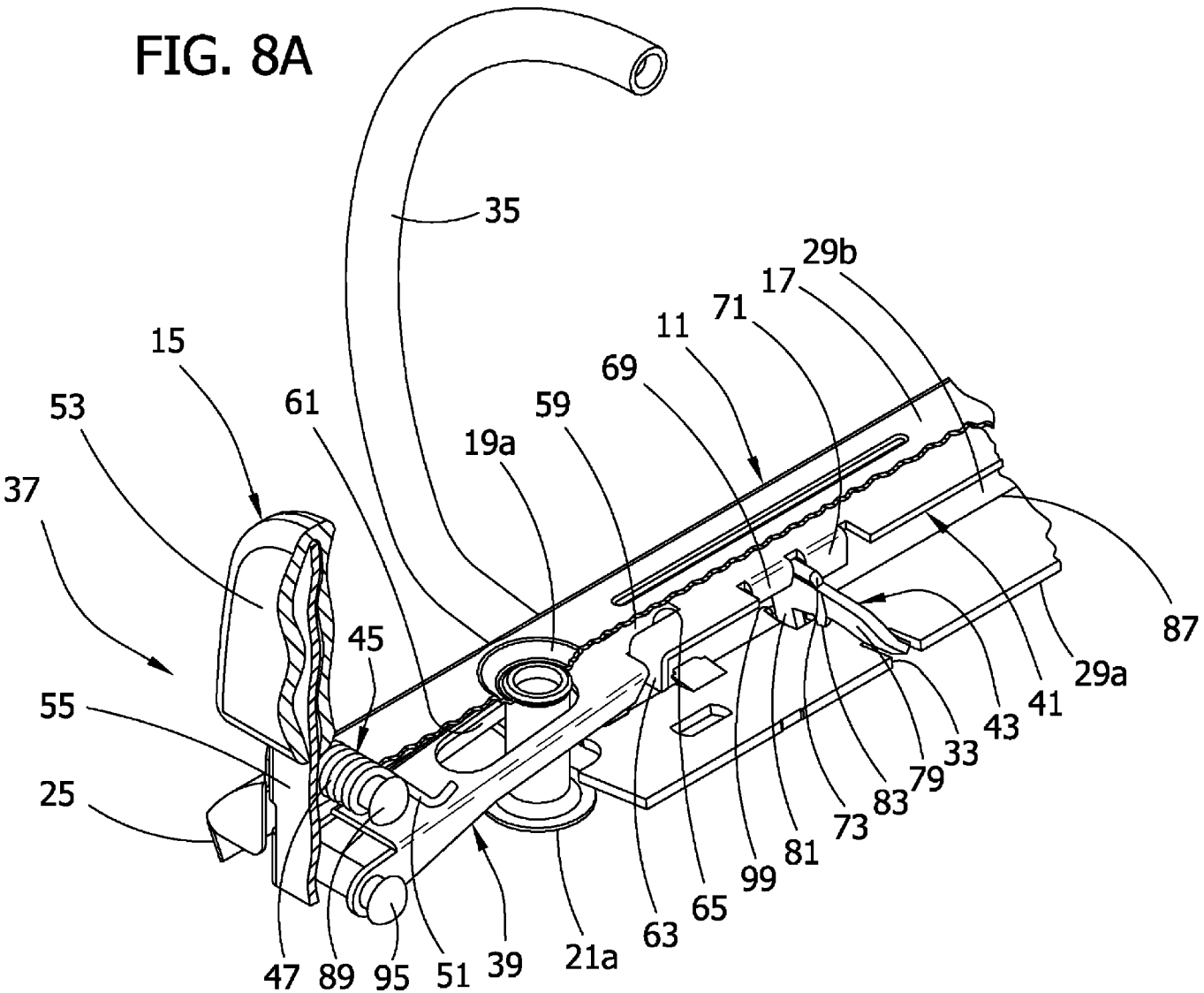
FIG. 8A is an enlarged fragmentary perspective of the mechanism at the closed and locked position with a portion of a housing and lever along with a ring member removed to show internal construction.
Figure 8B:
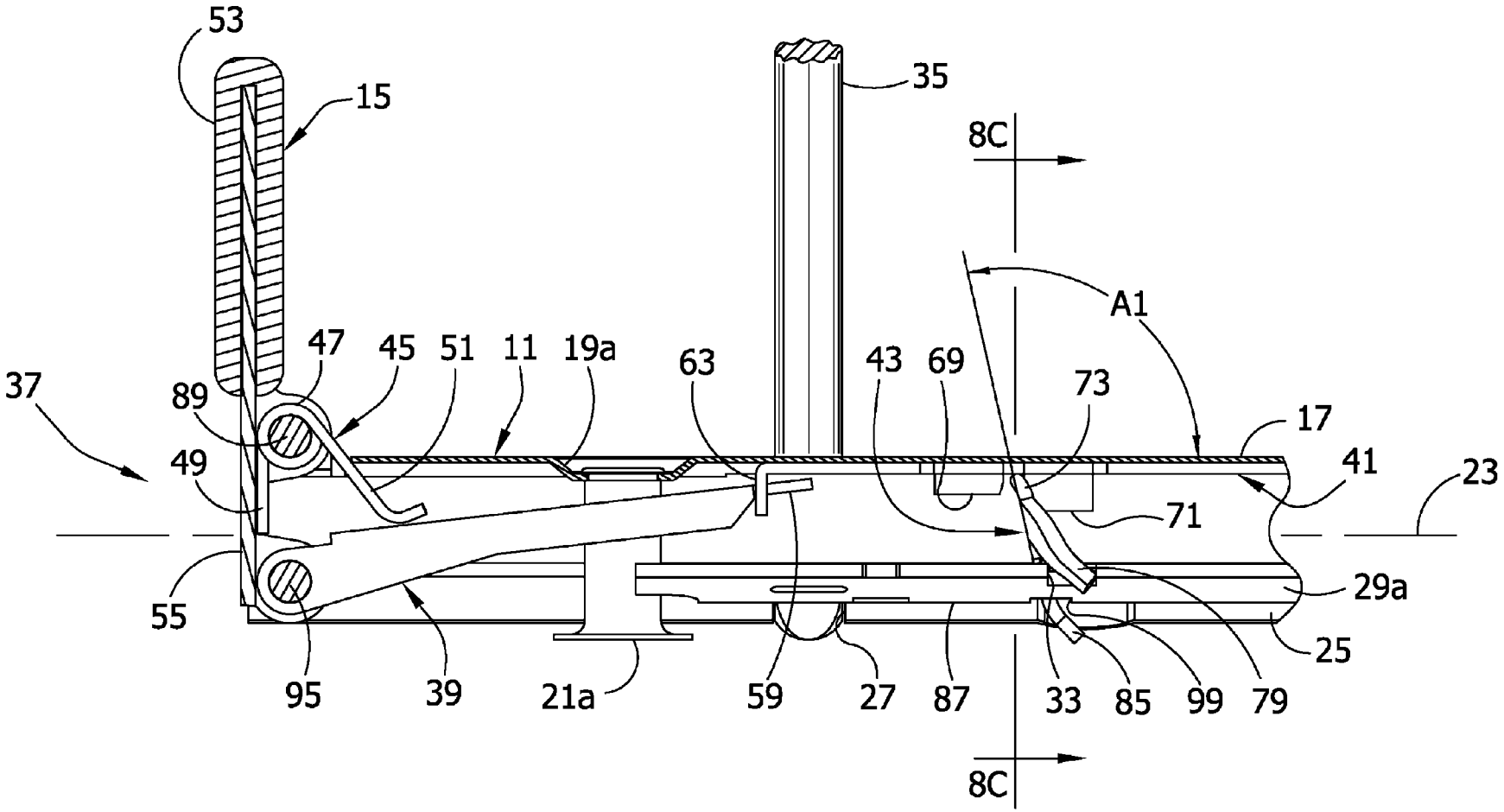
FIG. 8B is a side view of the mechanism of FIG. 8A with portions of lever hinge pins removed.
Figure 8C:
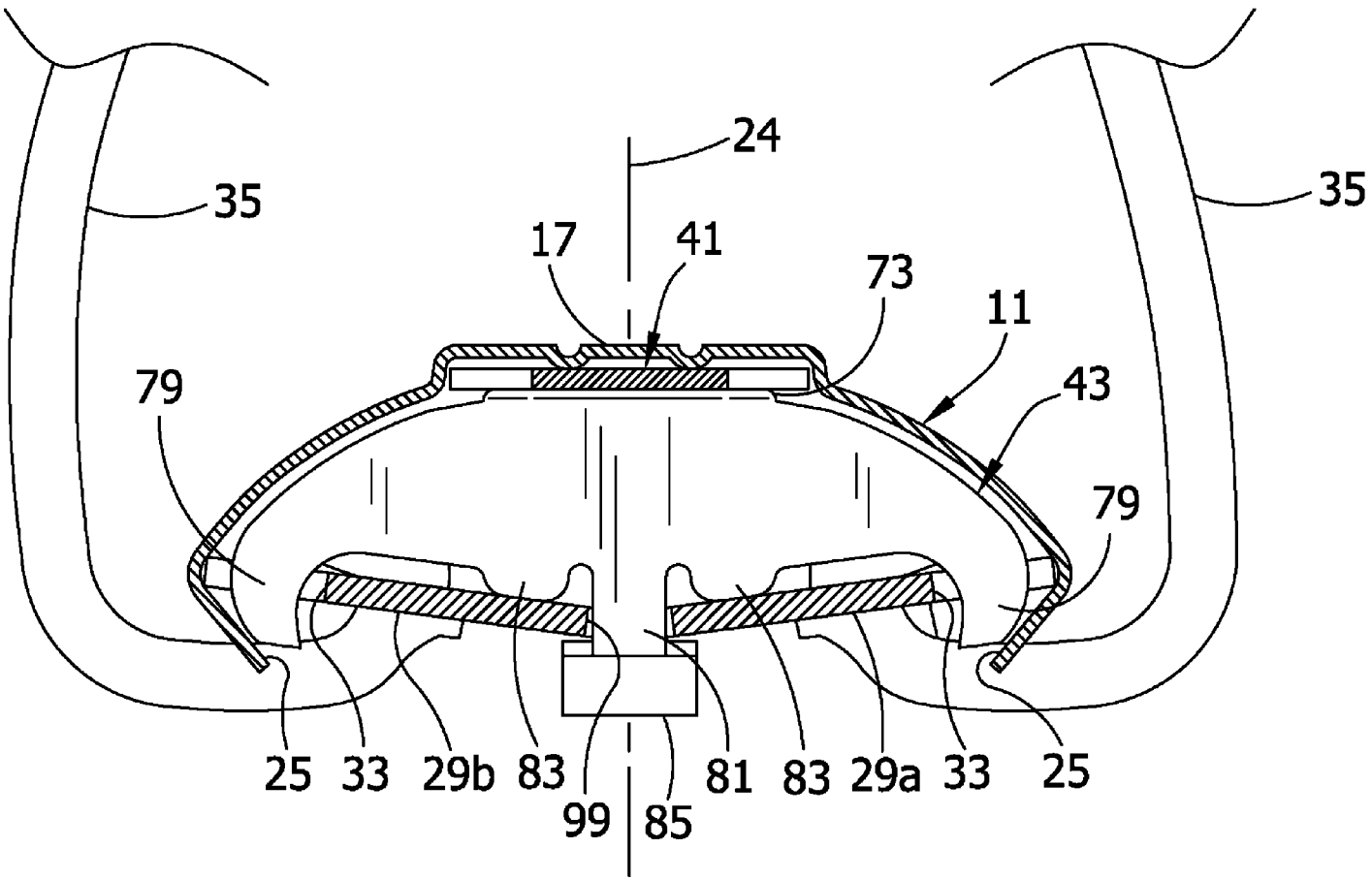
FIG. 8C is a transverse section taken on line 8C-8C of FIG. 8B.

As shown in FIGS. 4 and 8C, the housing 11 is shaped as an elongated rectangle with a uniform, generally arch-shaped elevated cross section having at its center a plateau 17. Two openings 19*a* and 19*b* are provided in the plateau 17 for receiving and attaching first and second mounting posts 21*a* and 21*b* to secure the mechanism 1 to the notebook 5 (see FIG. 1). The housing 11 also has a longitudinal axis 23, two generally opposite longitudinal edges, and the two opposite transverse ends of which the first (where the lever 15 is mounted) is generally open. A bent under rim 25 is formed along both longitudinal edges, and six holes (only three of which are visible), each designated by reference numeral 27, are positioned in the bent under rims along the longitudinal edges to receive the rings 13 through the rim. Mechanisms having housings of other shapes, including irregular shapes, or housings that are integral with a file or notebook do not depart from the scope of this invention.

Two substantially similar hinge plates, designated by reference numerals 29*a* and 29*b*, are supported by the housing 11 for pivoting movement during operation, as will be described in greater detail hereinafter. Each hinge plate 29*a* and 29*b* is a thin, elongate sheet having inner and outer longitudinal edge margins and two longitudinal ends. Three pairs of aligned notches 31 are formed in the inner edge margins of the hinge plates 29*a* and 29*b*, and corresponding locating cutouts 33 are formed along the outer longitudinal edge margins, each serving a purpose that will be described hereinafter.

Sill referring to FIG. 4, ring members 35 of each ring 13 are mounted on an underside of one of the two opposing hinge plates 29*a* and 29*b*. The ring members 35 are movable with the hinge plates 29*a* and 29*b* during operation between a closed position (FIGS. 1 and 2) wherein each ring member forms a continuous, D-shaped closed loop for retaining loose-leaf pages, and an open position (FIG. 3) wherein each ring member 35 forms a discontinuous, open loop suitable for adding or removing pages. The ring members 35 are formed from a conventional, cylindrical rod of a suitable material such as steel. Ring members having different cross-sections or ring members that form different shapes when closed (e.g., a circular loop as illustrated in later embodiments) do not depart from the scope of the invention. Although both ring members 35 of each ring 13 are movable in the illustrated embodiment, a mechanism in which each ring has a movable ring member and a fixed ring member does not depart from the scope of this invention (e.g., a mechanism in which only one of the ring members of each ring is mounted on a hinge plate with the other ring member mounted, for example, on a housing). A control structure of the invention, indicated generally at reference numeral 37, controls the pivoting movement of the hinge plates 29*a* and 29*b* that moves the ring members 35 between the closed and open positions. It also operates to lock the ring members 35 together when they are in the closed position. The control structure 37 includes the actuating lever 15, an intermediate connector 39, an elongate travel bar 41, and three connecting links 43, all of which are movable relative to the housing 11 and each of which are designated generally by their reference numeral. A mechanism having more or fewer than three connecting links does not depart from the scope of the invention.

The actuating lever 15 is located at the first, open longitudinal end of the housing 11. It includes an enlarged head 53, which facilitates gripping and applying force to the lever 15, extending from a narrow body 55. The head 53 may be integral with the lever body 55 or attached separately thereto, and a mechanism having a lever shaped differently than illustrated does not depart from the scope of the invention. The intermediate connector 39 is located between the lever 15 and the travel bar 41 and is elongate and beam shaped. One end of the connector 39 is generally wider than the other end with the narrower end including an enlarged head 59 projecting therefrom. An elongate slot 61 formed in the intermediate connector 39 allows the connector to move while receiving the first mounting post 21*a* through the slot. The travel bar 41 extends away from the connector 39 generally lengthwise of the housing 11 and parallel to the longitudinal axis 23 of the housing. The travel bar 41 is generally flat and elongate, and one end is bent down to form a shoulder 63 having a slot 65 that is elongate in the lengthwise direction of the travel bar. Three sets of stops 69 and 71 are uniformly arranged along the travel bar 41 with portions of each stop being formed on opposite longitudinal sides of the travel bar. The stops 69 and 71 can be formed, for example, by punching and folding a portion of the travel bar downward (only portions of stops on one side of the travel bar 41 are visible in the drawings).

Figure 5:
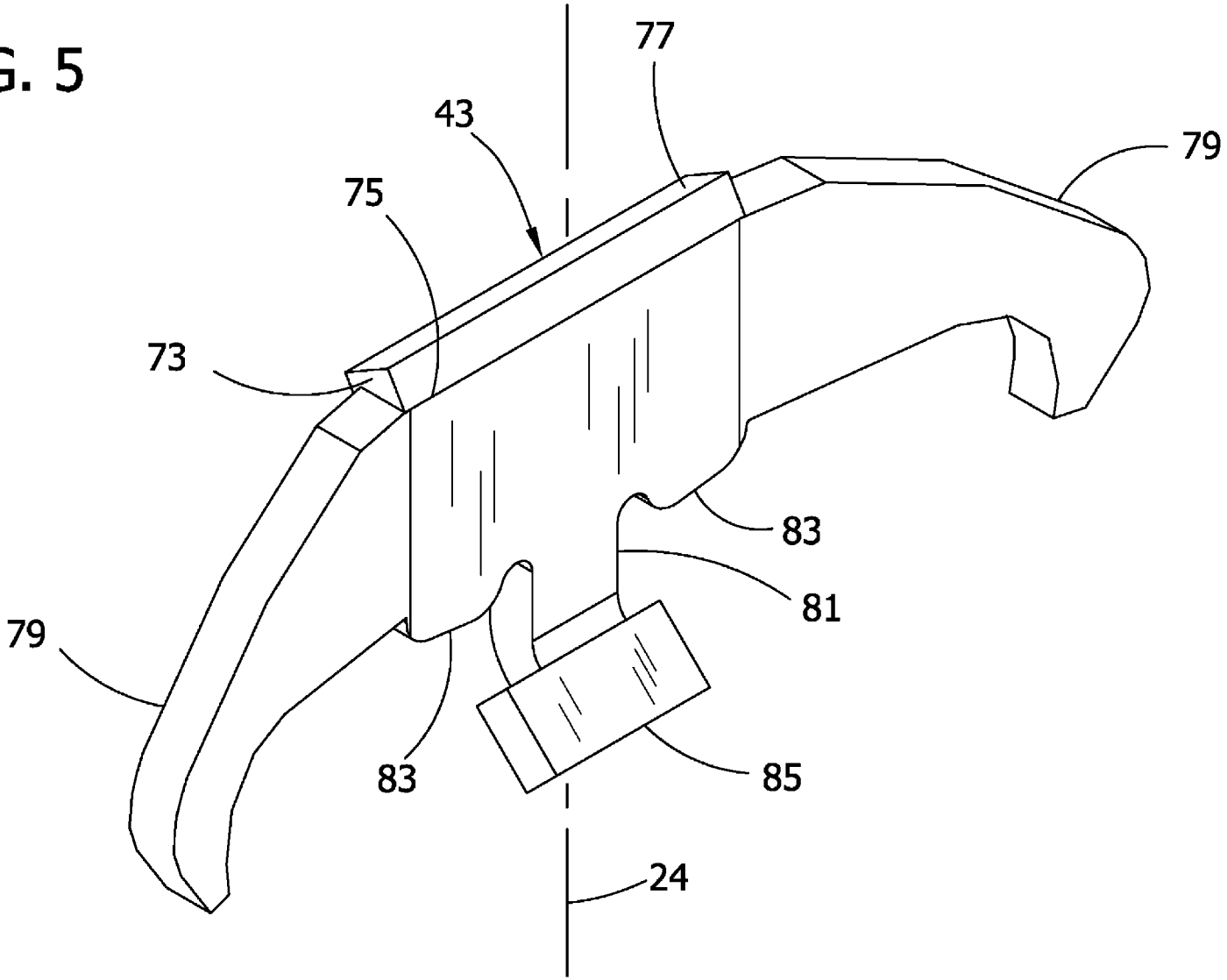
FIG. 5 is an enlarged perspective of a carrier link of the mechanism.

A coiled torsion spring, or shank spring, 45 is located adjacent the lever 15 and interacts with the control structure 37 to urge it to a locked position when the ring members 35 are closed. In the illustrated embodiment, the torsion spring 45 includes a coiled body 47 and two free ends 49 and 51. Its interaction with the control structure 37 will be described in greater detail hereinafter. The three connecting links 43 are spaced uniformly apart at locations along the mechanism 1 closely adjacent respective pairs of ring members 35. As shown better in FIG. 5, each connecting link 43 has a tongue 73 projecting from a top center of the link at an angle relative to the link, as shown at line 75. An upper peripheral edge 77 of the tongue 73 is generally straight and flat. A pair of locating arms, each designated by reference numeral 79, extend laterally outward from opposite sides of the connecting link 43, and a tab 81 and two lugs, each lug being designated by reference numeral 83, depend from a lower center of the link. The tab 81 is located between the two lugs 83 and includes a retainer 85 angling outward from the tab in a direction generally opposite to the direction in which the tongue 73 extends. The retainer 85 is wider than the tab 81, the reason for which will be described in greater detail hereinafter.

Figure 6:
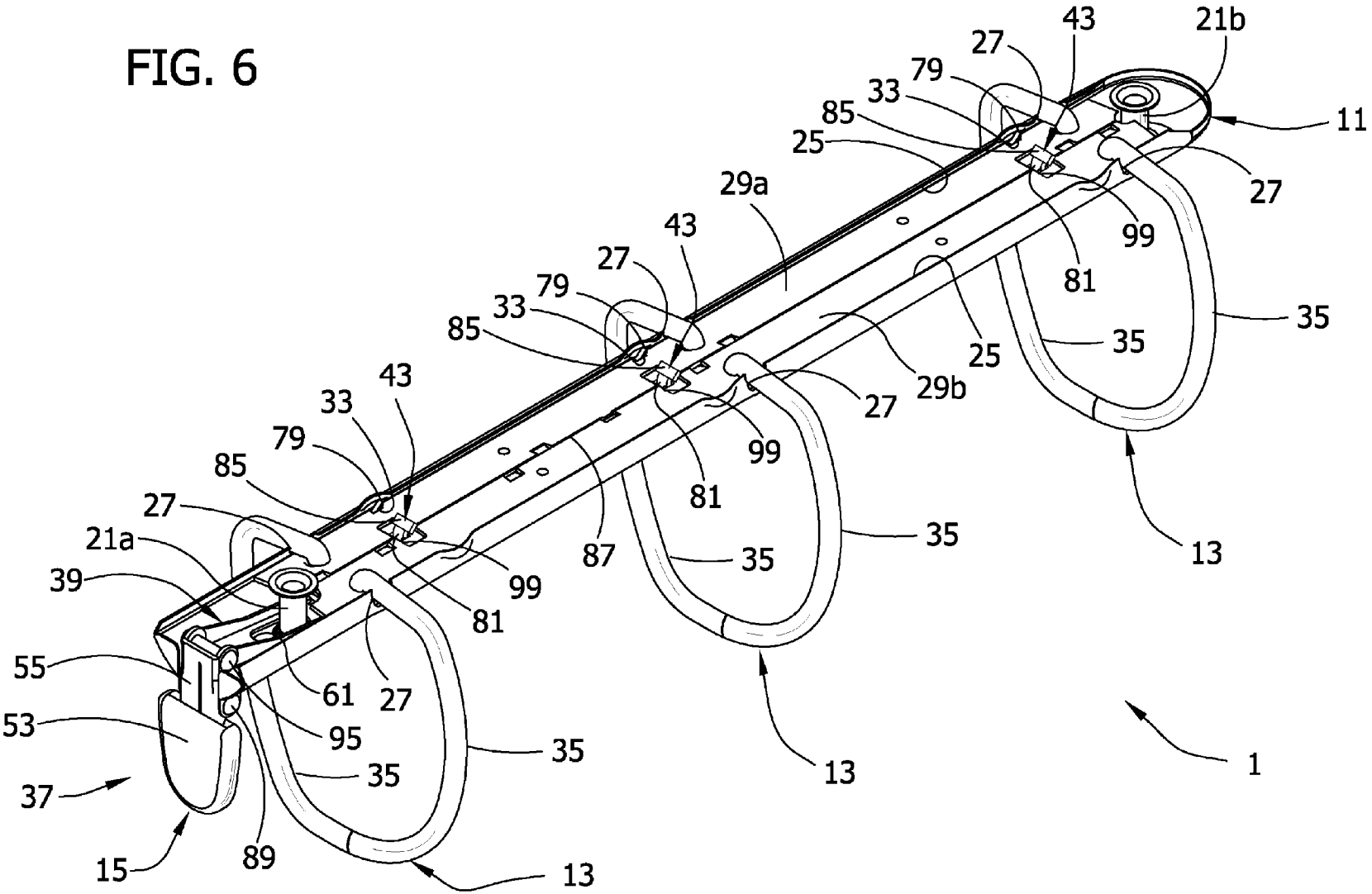
FIG. 6 is a bottom perspective of the mechanism at the closed and locked position.
Figure 7:
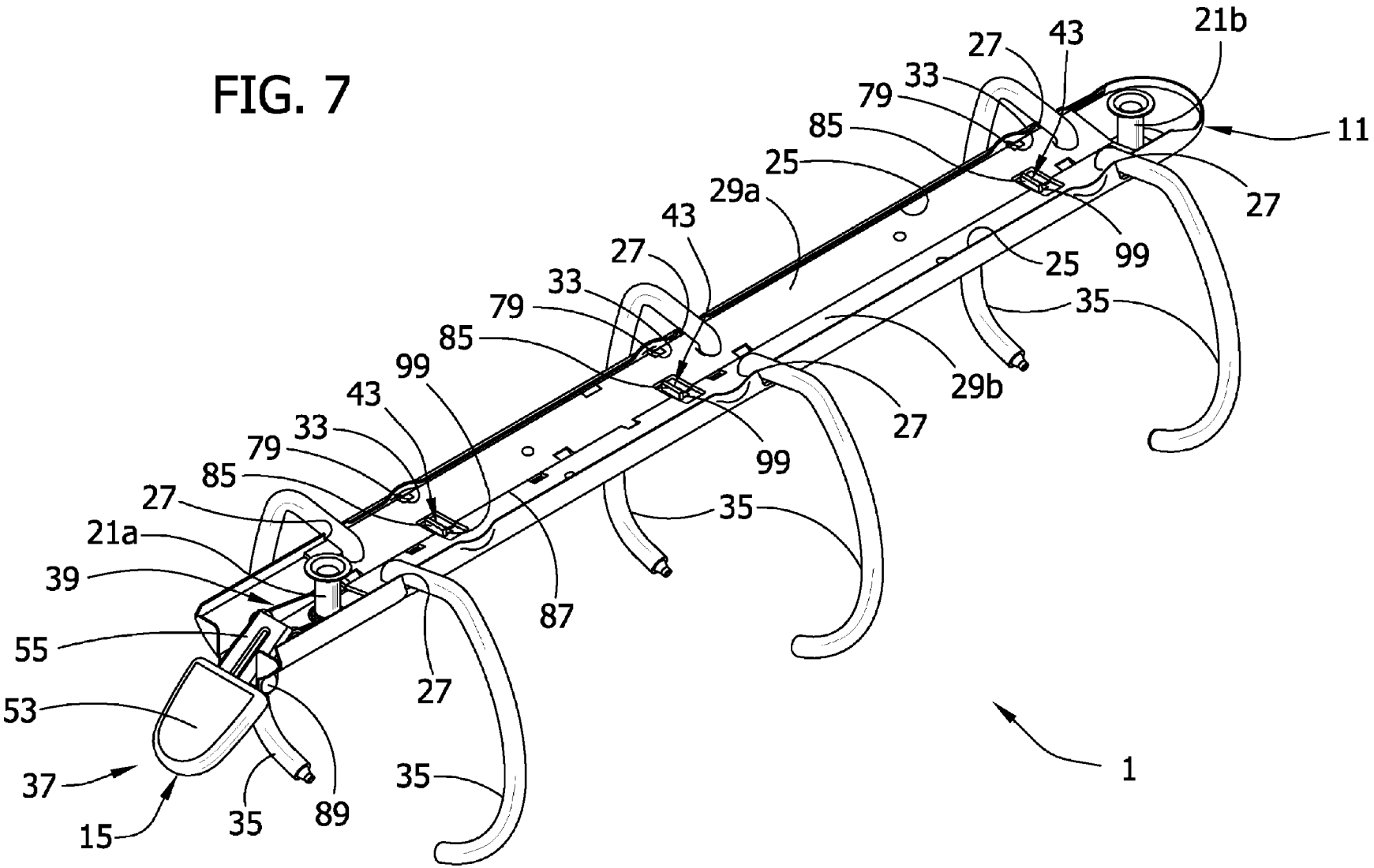
FIG. 7 is a perspective similar to FIG. 6 with the mechanism at the open position.

Referring now to the ring binder mechanism 1 in assembled form and in particular to FIGS. 6 and 7, the housing 11 loosely supports the hinge plates 29*a* and 29*b* in parallel arrangement such that the outer longitudinal edge margin of each hinge plate is received in the corresponding bent under rim 25 of the housing 11. The inner longitudinal edge margins of hinge plates 29*a* and 29*b* engage each other and form a hinge 87. In this arrangement, the outer edge margins are free to move within the rim 25 as the plates 29*a* and 29*b* pivot about the hinge 87. The hinge moves down (i.e., away from the housing 11 as shown in FIG. 6) when the plates 29*a* and 29*b* pivot to close the rings 13 (closed position), and it moves up (i.e., toward the housing 11 as shown in FIG. 7) when the hinge plates pivot to open the rings (open position). In the illustrated mechanism 1, the housing 11 provides a small spring force to bias the hinge plates 29*a* and 29*b* to pivot away from a co-planar position of the plates (i.e., to pivot toward either the closed position or the open position). However, the biasing force provided by the housing 11 is substantially smaller than on conventional ring binder mechanisms. Preferably, the housing 11 provides a force which is as small as it can be while still supporting the hinge plates 29*a* and 29*b*.

Now referring to FIGS. 8A and 8B, it can be seen that the lever 15 is pivotally mounted on the first longitudinal end of the housing 11 by hinge pin 89 through holes 91 of the lever and holes 92 of the housing (holes 91 and 92 are shown in FIG. 4) in a position readily accessible for grasping the enlarged head 53 and pivoting the lever 15. As also seen, the travel bar 41 is disposed behind the plateau 17 of the housing 11 and is connected to the lever 15 by the intermediate connector 39. The wider end of the intermediate connector 39 is pivotally connected to the lever 15 by hinge pin 95 through holes 96 of the lever 15 and holes 97 of the connector 39 (see FIG. 4) at a location below where the lever is mounted on the housing 11 by pin 89. The enlarged head 59 of the narrower end of the connector 39 is received in the slot 65 in the shoulder 63 of the travel bar 41, allowing the intermediate connector to push against the shoulder of the travel bar while the enlarged head 59 is engageable with the other side of the shoulder 63. This allows the intermediate connector 39 to freely pivot up and down with respect to the travel bar 41, and the travel bar to freely move up and down without hindrance from the connector. The elongate slot 61 in the intermediate connector 39 is positioned around the first mounting post 21*a* so that the connector can move longitudinally while receiving the first mounting post through the slot. Force is therefore transmitted from the lever 15, around the post 21*a*, and to the travel bar 41 while keeping direction of the force along a centerline of the connector 39. Thus, the connector is able to transmit force from the lever 15 to the travel bar 41 such that application of force to the lever produces the translational movement of the travel bar. It should be understood that pivotal motion of a lever, such as that shown in the illustrated embodiments, provides for application of a lesser force by an operator when moving a travel bar than would be necessary to translate the bar directly as by pushing or pulling, and does so without the travel bar protruding from a housing. A mechanism in which a pivoting lever is directly connected to a travel bar does not depart from the scope of the invention.

FIGS. 8A and 8B also illustrate orientation of the torsion spring 45 relative to the control structure 37. As can be seen, the torsion spring 45 is connected to the housing 11 by the hinge pin 89, which also mounts lever 15 on the housing, through the coiled body 47 of the torsion spring. The first free end 49 of the torsion spring 45 (FIG. 8B) engages the lever 15 while second free end 51 engages the housing 11 and intermediate connector 39. Thus, the torsion spring 45 is oriented to resist movement of the control structure 37 in a direction tending to open the ring members 35. In particular, the torsion spring 45 resists pivoting movement of the lever 15 outward and downward (i.e., movement of the first end 49 of the spring 45 toward the second end 51), which, as will be described in greater detail hereinafter, operates to open the ring members 35.

Referring now to FIGS. 8A-8C, each connecting link 43 (only one connecting link is shown in the drawings) is positioned between the travel bar 41 and the hinge plates 29*a* and 29*b*, and together the three links pivotally support the travel bar above the plates, in effect operatively connecting the travel bar to the hinge plates. The tongue 73 of each link 43 is loosely and pivotally received between the stops 69 and 71 of the travel bar 41 such that the angle of the tongue is generally toward the lever 15. As best seen in FIG. 8B, the stops 69 and 71 are directionally configured for limiting angular pivotal motion of the connecting links 43 relative to the travel bar 41 during operation. The angle of stops 69 differs from the angle of the opposing stops 71 such that a maximum relative angle between the connecting links 43 and travel bar 41 may be greater in one longitudinal direction than in the opposite longitudinal direction (compare FIGS. 8B and 9B). This is described in greater detail hereinafter.

Referring now particularly to FIG. 8C and the orientation of the connecting links 43, the lugs 83 of each link engage upper surfaces of the two hinge plates 29*a* and 29*b* adjacent the hinge 87 (see FIG. 8A) while the tab 81 loosely fits through opening 99 formed by the aligned notches 31 at the hinge 87. In this position, the tab retainer 85 is located under the hinge plates 29*a* and 29*b*. The retainer 85 is wider than the corresponding hinge plate opening 99 and thus prevents the tab 81 from being fully withdrawn from the opening during operation. The locating arms 79 of each link 43 extend through the corresponding locating cutouts 33 in the outer edge margins of the hinge plates 29*a* and 29*b*. The arms 79 are received sufficiently loosely in the locating cutouts 33 so as not to interfere with the pivoting motion of the connecting link 43. This helps attach the links 43 to the plates 29*a* and 29*b* and locate the links against canting movement (e.g., movement about a vertical axis 24 of the link 43 perpendicular to the longitudinal axis 23 of the housing 11). Accordingly, the connecting links 43, and thus the travel bar 41, are always in connection with the hinge plates 29*a* and 29*b*. The loose fit of the tab 81 and locator arms 79 with the hinge plates 29*a* and 29*b* allows the tab retainer 85 to move toward and away from the underside of the hinge plates while permitting the connecting link 43 to pivot with respect to the hinge plates. Thus, in operation the links 43 can pivot on the hinge plates 29*a* and 29*b* in an angular motion relative to both the hinge plates and the housing 11 when the travel bar 41 moves lengthwise; more specifically, the connecting links can pivot about an axis transverse to each the longitudinal axis 23 of the housing and the vertical axis 24 of the link 43.

Operation of the mechanism 1 for moving ring members 35 between the open and closed positions will now be described with reference to FIGS. 8A-9B. As shown in FIGS. 8A-8C, when the ring members 35 are closed, the mechanism 1 is locked and the lever 15 is in an upright position with the hinge plates 29*a* and 29*b* hinged down and away from the housing 11. The connecting links 43 (only one is shown) are in an over center position, generally angling toward the lever 15. As best shown in FIG. 8B, a typical angle Al of each connecting link 43 relative to the housing 11 is about 95° to about 100°. The lugs 83 firmly engage the hinge plates 29*a* and 29*b* and block pivoting motion of the plates. Any force tending to open the ring members 35 is firmly opposed by the three connecting links 43.

To open the ring members 35, an operator applies force to the lever 15 and progressively pivots it outward and downward. This moves the first free end 49 of the torsion spring 45 toward the second free end 51 (compressing the torsion spring) and pushes the intermediate connector 39 and travel bar 41 away from the end of the housing 11 having the lever 15. The travel bar movement simultaneously and pivotally begins moving the connecting links 43 from their over center position, through a generally vertical position, and to a position angling away from the lever 15. The preset angle of each connecting link tongue 73 inhibits occurrence of the link 43 becoming stopped at a vertical position with little or no tendency to move away from that position. During this initial opening operation, the torsion spring 45 resists the pivoting movement of the lever 15. So if the lever is 15 is released before the ring members open, the torsion spring 45 immediately urges the lever back to the upright position, pulling the intermediate connector 39, travel bar 41, and connecting links 43 back to the locked position (FIG. 8B).

Figure 9A:
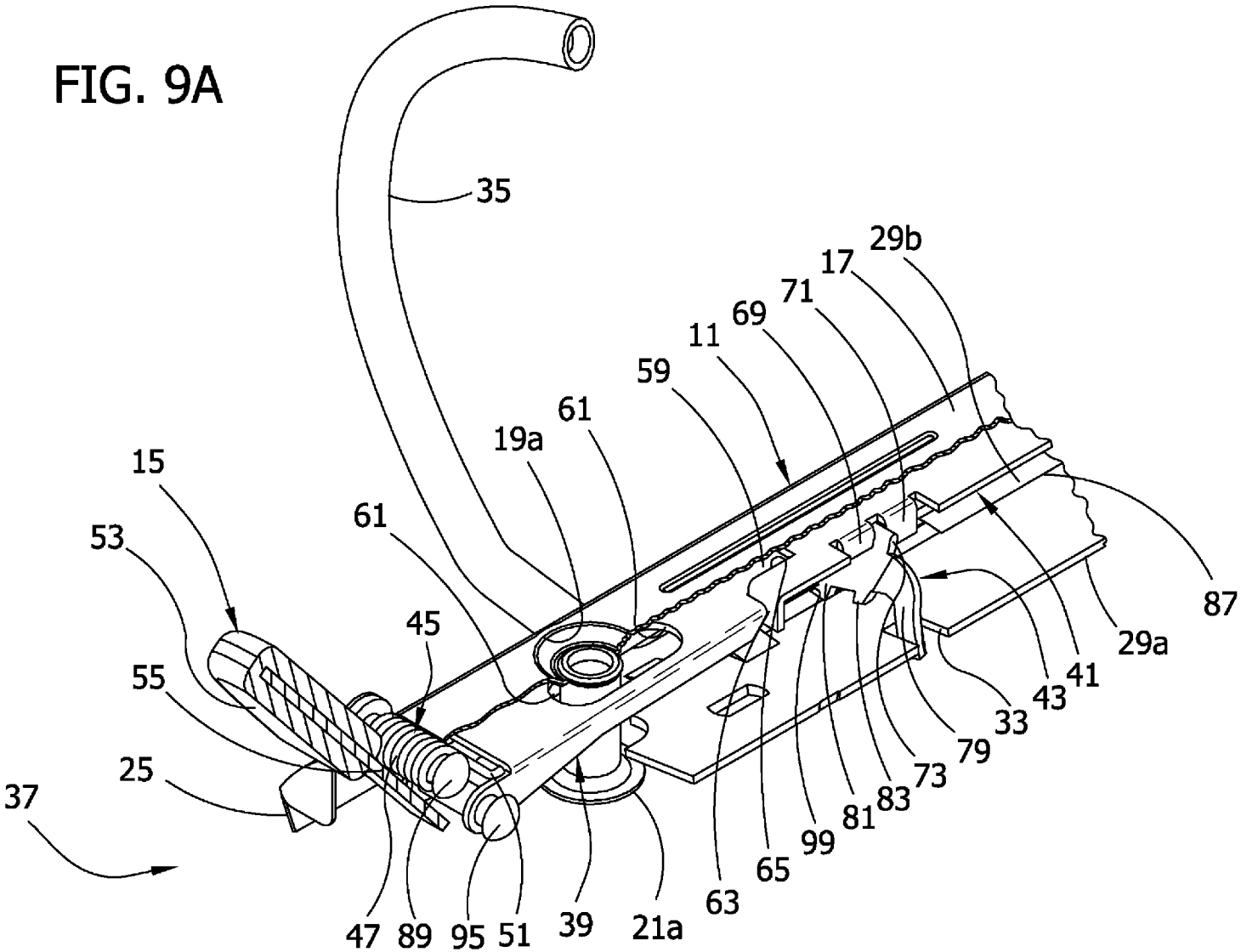
FIG. 9A is a fragmentary perspective similar to FIG. 8A with the mechanism at the open position.
Figure 9B:
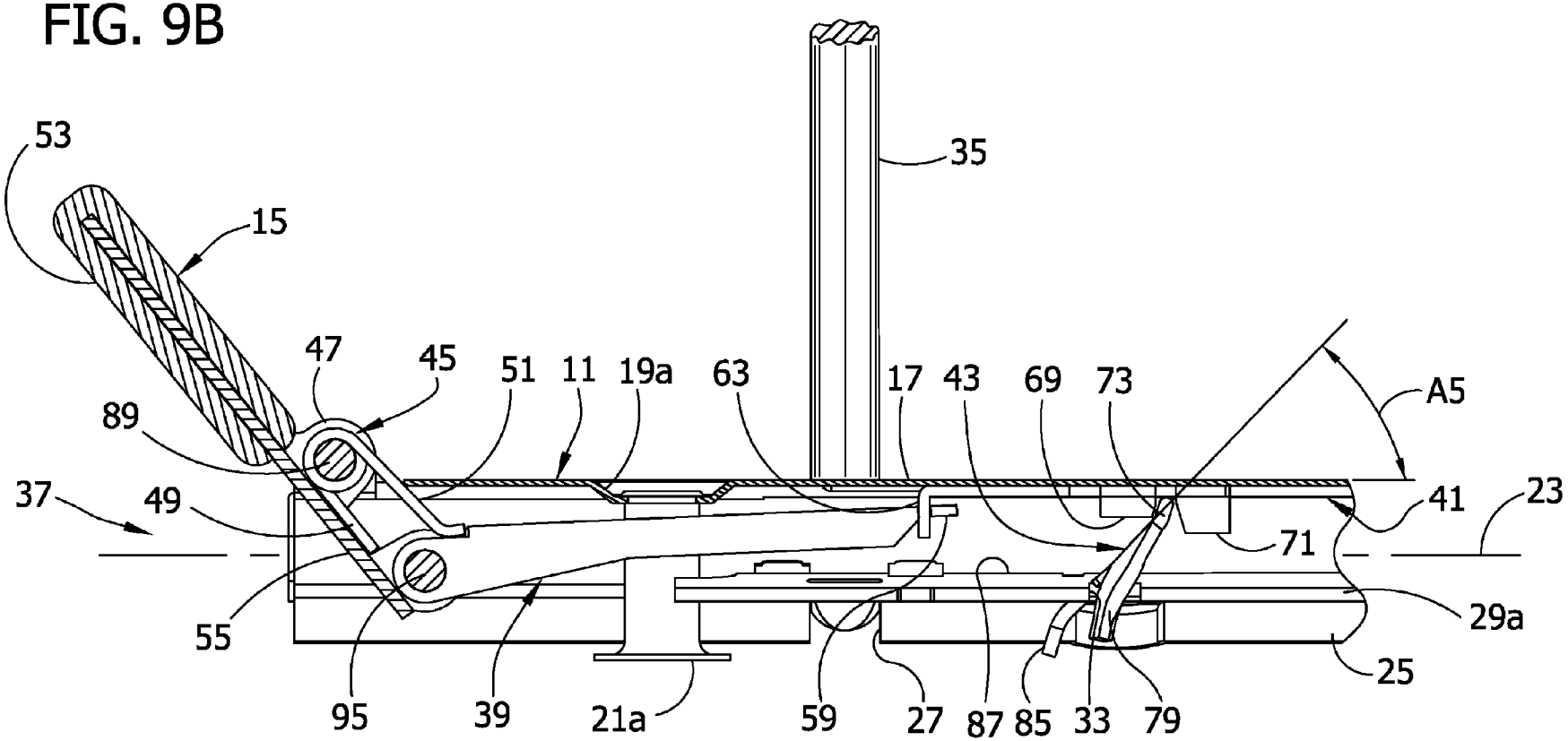
FIG. 9B is a side view thereof with portions of lever hinge pins removed.

As the operator continues to pivot the lever 15, the travel bar 41 continues to move away from the lever and further pivots each connecting link 43 generally away from lever 15. Pivoting movement of the links 43 positions the retainer 85 of each link in engagement with a bottom surface of the hinge plates 29*a* and 29*b*. So as the links 43 pivot, they pull the hinge plates 29*a* and 29*b* upward and through the co-planar position of the plates, opening the ring members 35 (FIGS. 9A and 9B). In this open position, a typical angle A5 of the links 43 relative to the housing 11 is about 30° to about 45° (FIG. 9B). The hinge plates 29*a* and 29*b* are in an upwardly hinged position and, under the spring force (clamping force) of the housing 11, hold the connecting links 43 in the position shown in FIGS. 9A and 9B against the force of the torsion spring 45 urging the lever 15 to the upright position and tending to close the ring members 35 (and move the control structure 37 to the locked position). The over center orientation of the connecting links 43 also helps to resist the urging force of the torsion spring 45. But this resistance is small, and alone is not sufficient to resist the spring's urge. Primary resistance to the urging force of the torsion spring 45 is from the housing 11.

To close the open ring members 35 and return the mechanism 1 to the locked position, the operator may either pivot the lever 15 upward and inward or manually push the ring members 35 together. Pivoting the lever 15 pulls the intermediate connector 39 and travel bar 41 toward the lever. This correspondingly pivots the connecting links 43 generally back toward lever 15. The connecting link lugs 83 push down on the hinge plates 29*a* and 29*b*, causing them to pivot downward and through the co-planar position. As soon as the hinge plates 29*a* and 29*b* pass through the co-planar position (and the housing spring force biases them fully downward to their closed position), the ring members 35 close and the torsion spring 45 automatically urges the lever 15 to pivot toward its upright position. This lever movement pulls the travel bar 41 which pivots the connecting links 43 back to their over center position toward lever 15, blocking pivoting motion of the hinge plates that opens the ring members 35 (FIGS. 8A-8C). The preset angle of each connecting link tongue 73, combined with the bias form the torsion spring 45, inhibits occurrence of the link 43 becoming stopped at a vertical position with little or no tendency to move away from that position during this closing and locking operation. A mechanism with connecting links forming different angles A1 and A5 than described and illustrated herein does not depart from the scope of the invention.

The several benefits of the ring binder mechanism 1 of the invention should now be apparent. For example, the torsion spring 45 directly acts on the actuating lever 15 when urging it to move the control structure 37 to the locked position. More specifically, the spring 45 is mounted generally adjacent a pivot axis of the lever 15 and is oriented to urge the lever to pivot to move the control structure 37. Accordingly, the spring 45 utilizes the mechanical advantage associated with the pivoting lever 15 to automatically lock the mechanism 1.

Another advantage of the mechanism 1 of the invention is that torsion spring 45 can be mounted on the housing 11 in an operable position adjacent the lever using the hinge pin 89 used to mount the lever 15. Additional parts are not necessary to accommodate the spring 45 in the mechanism, which may reduce manufacturing costs for the mechanism. Furthermore, parts of the mechanism 1 do not need to be specially formed to accommodate the spring 45 (e.g., no additional openings need be formed in the travel bar 41 or hinge plates 29*a* and 29*b*). This may also reduce manufacturing costs. These advantages generally apply to each embodiment described herein.

Figure 10:
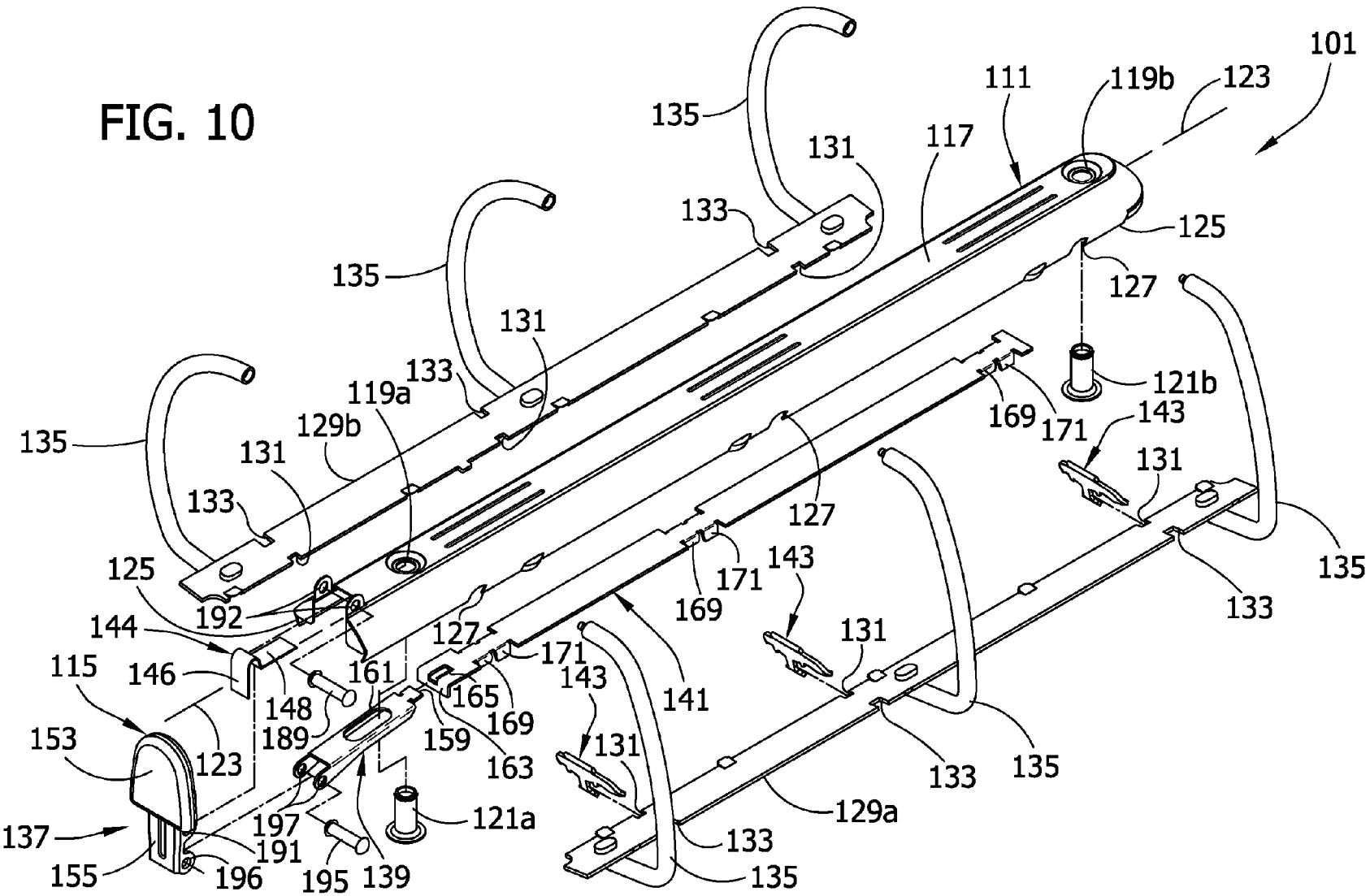
FIG. 10 is an exploded perspective of a ring binder mechanism according to a second embodiment of the invention.
Figure 11A:
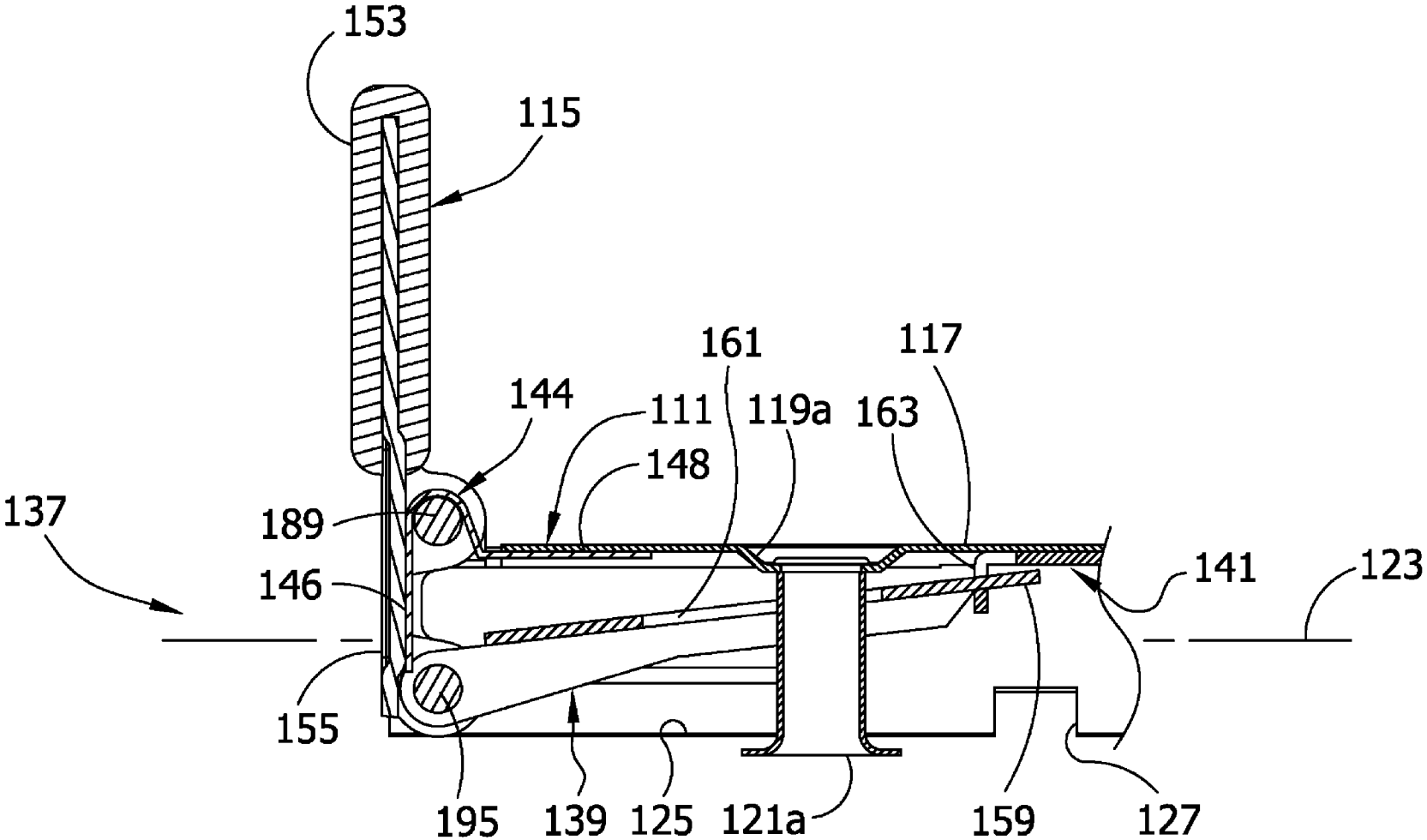
FIG. 11A is a fragmentary longitudinal section of the mechanism of FIG. 10 at a closed and locked position and with hinge plates and ring members removed.
Figure 11B:
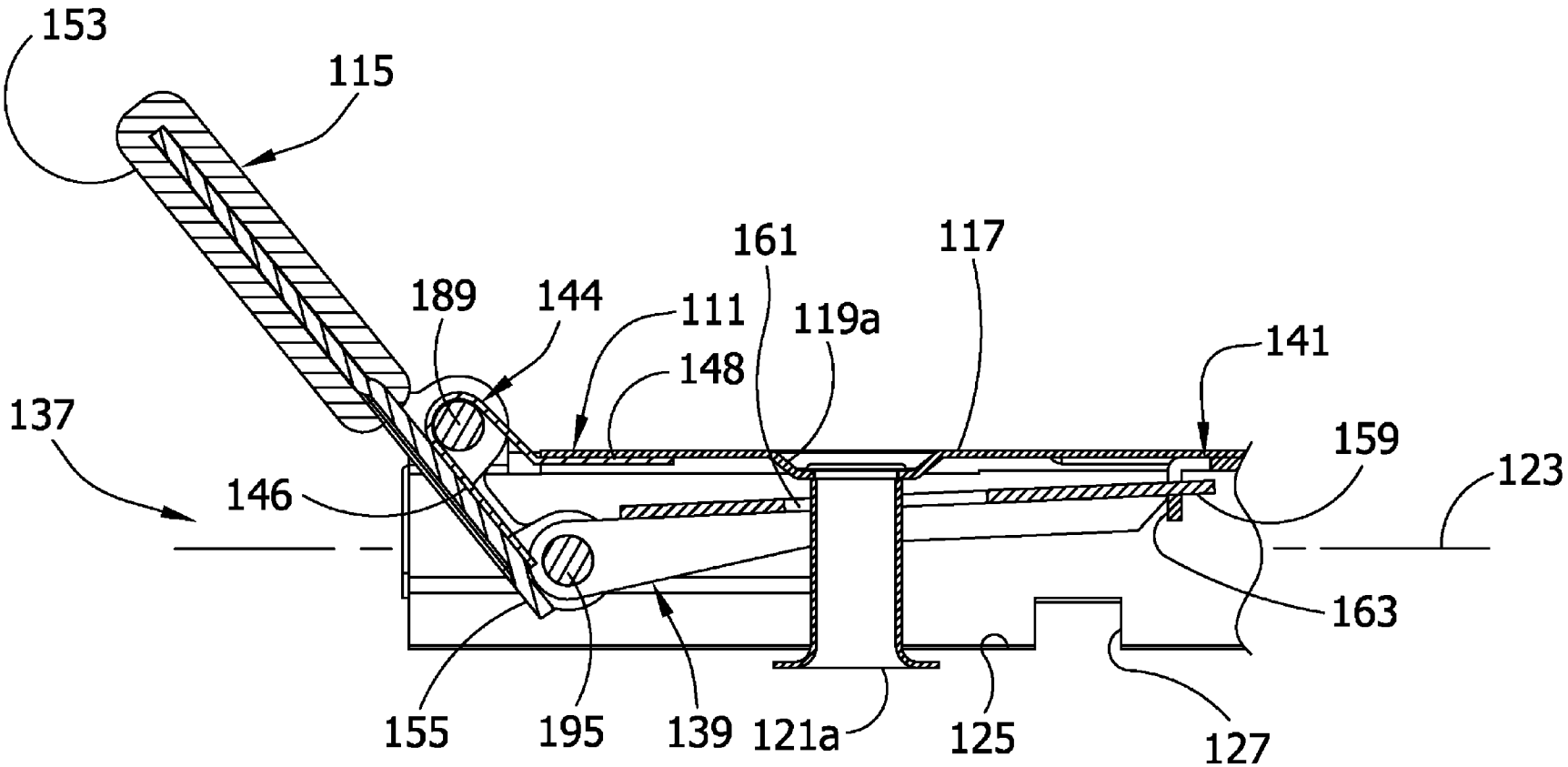
FIG. 11B is a section similar to FIG. 11A with the mechanism at an open position.

A second embodiment of the ring binder mechanism of the invention is shown generally at reference numeral 101 in FIGS. 10-11B. Parts of this embodiment corresponding to parts of the mechanism 1 of the first embodiment are designated by the same reference numerals, plus "100". The mechanism 101 of this embodiment is substantially similar to the mechanism 1 of the first embodiment except that a spring plate 144 is used for urging control structure 137 (through lever 115) toward a locked position when ring members 135 are moved to a closed position. The spring plate 144 is a generally elongate, flat piece of metal that is bent into a general L-shape. A mounded channel, the purpose of which will become apparent shortly, is formed along a width of the plate 144 adjacent the bend. First and second free ends 146 and 148, respectively, are located on opposite sides of the mounded channel and are relatively oriented at about 90°.

As best shown in FIG. 11A, the spring plate 144 is mounted on the housing 111 by hinge pin 189, which also mounts the lever 115 on the housing. The mounded channel of the plate 144 is received on the pin 189 and the first free end 146 of the spring plate engages lever 115 while the second free end 148 engages the housing 111 under plateau 117. Pivoting movement of the lever 115 outward and downward (FIG. 11B) tending to open the ring members pivots the spring plate 144 about the hinge pin 189 and moves the two ends 146 and 148 of the spring plate closer together. This creates a tension in the spring plate 144 that tends to urge the lever 115 back to the full, upright, and locked position, similar to the urging force provided by the previously described torsion spring 45 of the first embodiment.

Figure 12:
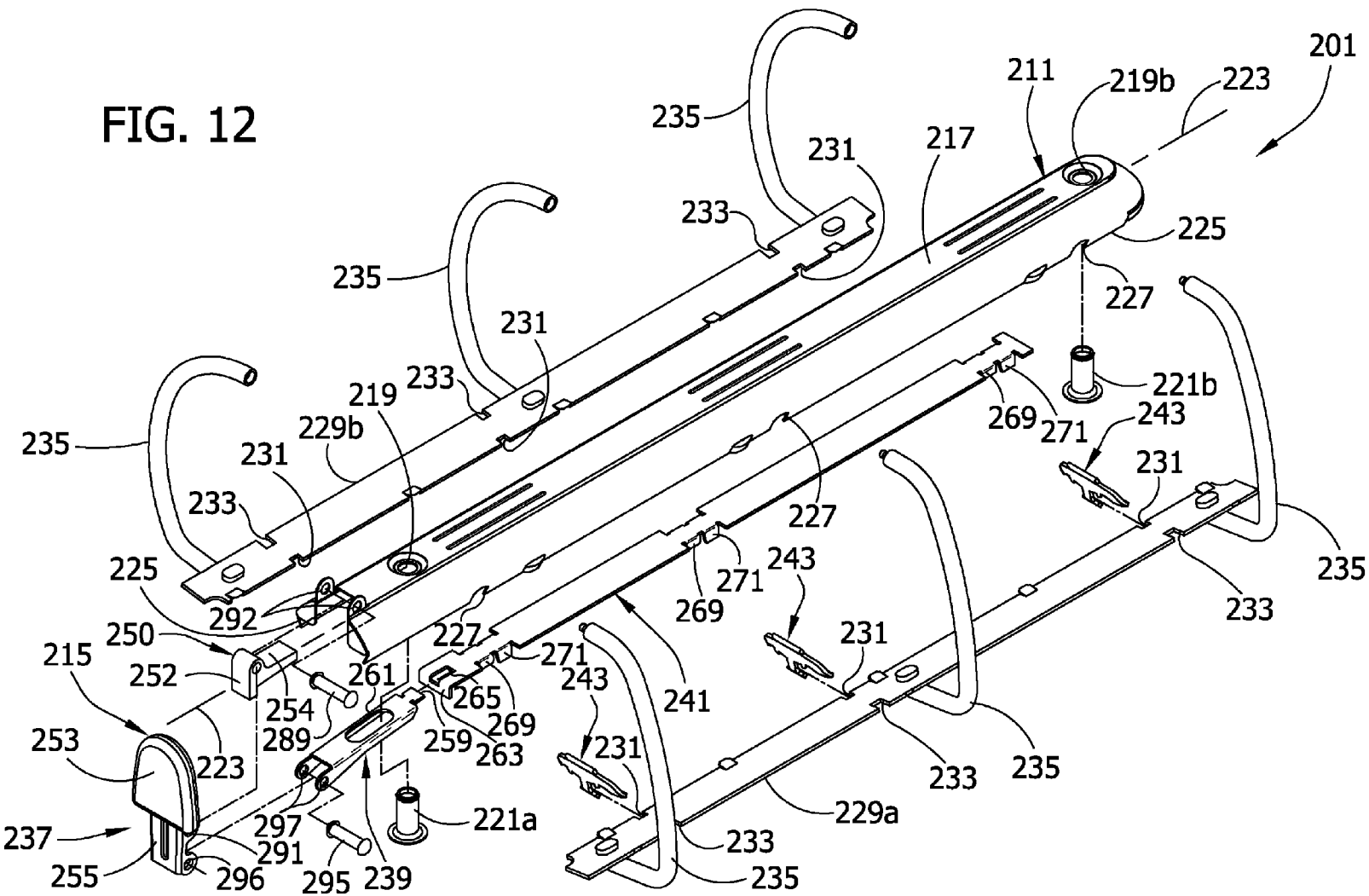
FIG. 12 is an exploded perspective of a ring binder mechanism according to a third embodiment of the invention.
Figure 13A:
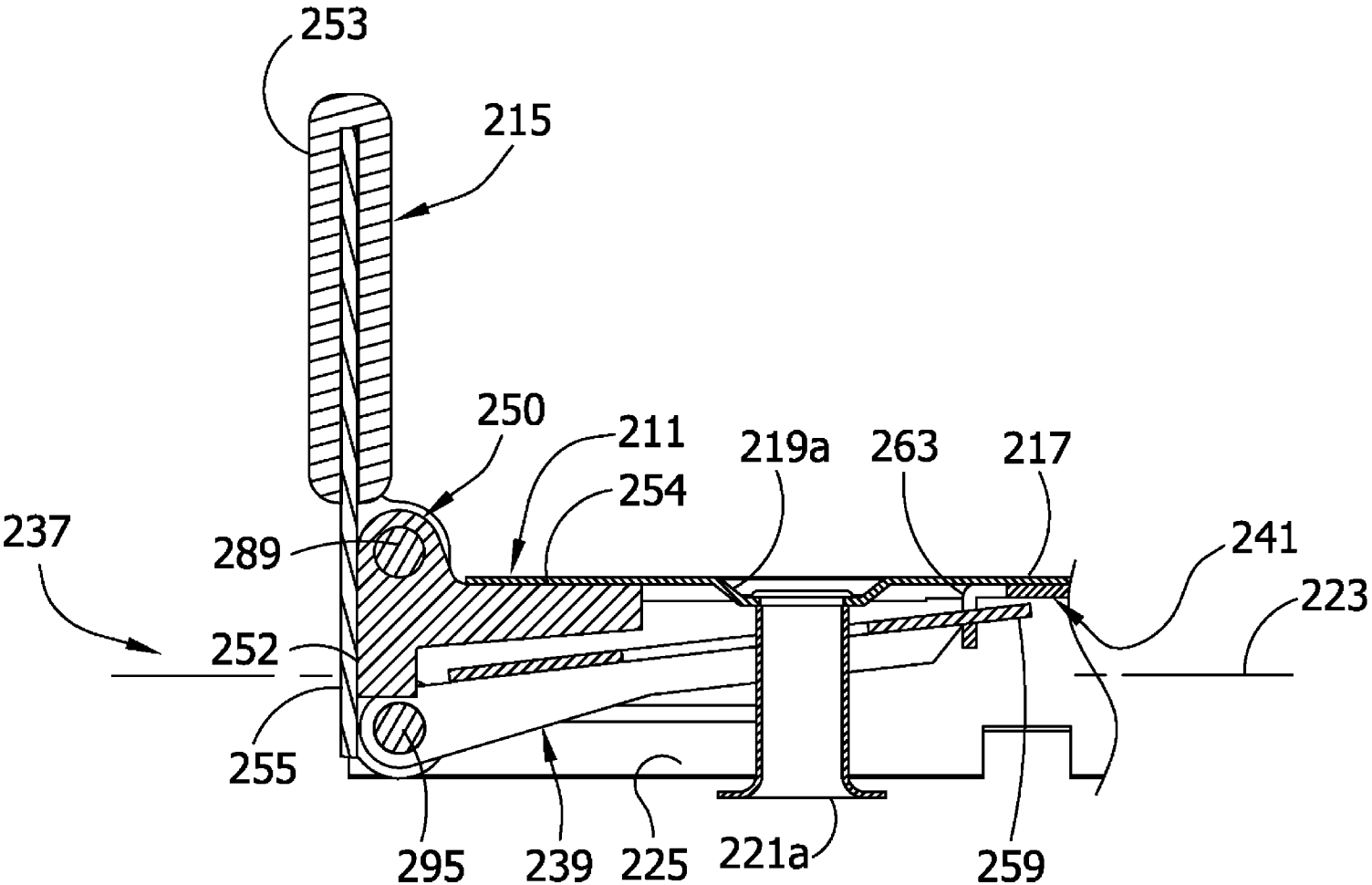
FIG. 13A is a fragmentary longitudinal section of the mechanism at a closed and locked position with hinge plates and ring members removed.
Figure 13B:
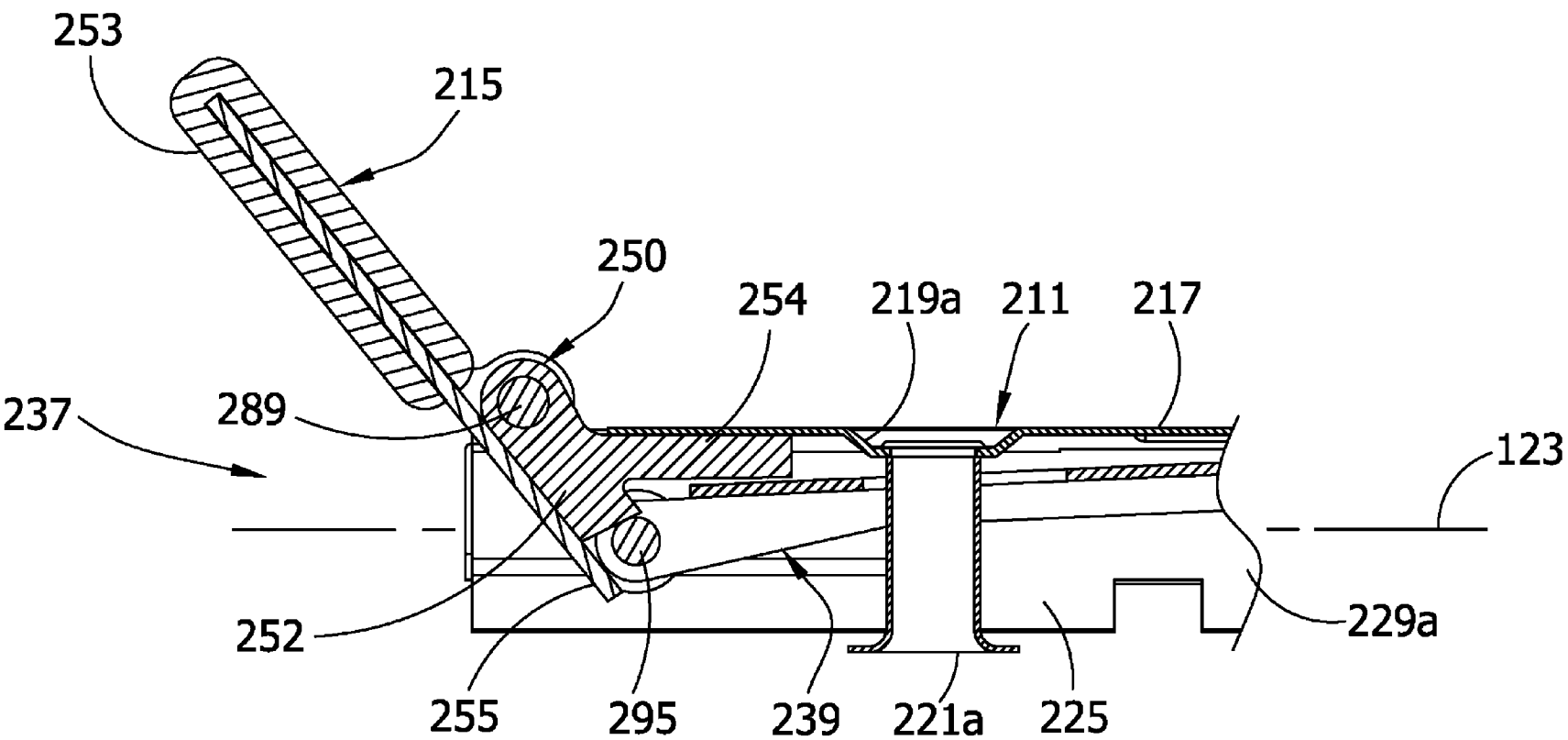
FIG. 13B is a section similar to FIG. 13A with the mechanism at an open position.

A third embodiment of the ring binder mechanism of the invention is shown generally at reference numeral 201 in FIGS. 12-13B. Parts of this embodiment corresponding to parts of the mechanism 1 of the first embodiment are designated by the same reference numerals, plus "200". The mechanism 201 of this embodiment is again substantially similar to the mechanism 1 of the first embodiment except that a rubber spring 250 is used for urging control structure 237 (through lever 215) toward a locked position when ring members 235 are moved to a closed position. The rubber spring 250 is generally a solid mass of plastic or rubber, or other bendable elastic material, formed into an L-shape. First and second free ends 252 and 254, respectively, of the spring 250 are relatively oriented at about 90°, and a ridge extends widthwise across the spring 250 between the two ends 252 and 254. An opening is located in the ridge passing through the rubber spring 250, the reason for which will be shortly described.

As shown in FIG. 13A, the rubber spring 250 is mounted on housing 211 by hinge pin 289, which also mounts lever 215 on the housing, through the opening in the spring's ridge. The first free end 252 of the rubber spring 250 engages lever 215 on the travel bar side of the lever while the second free end 254 engages the housing 211 under plateau 217. As with the previous embodiments, pivoting movement of the lever 215 outward and downward (FIG. 13B) opens the ring members 235. This pivoting movement also pivots the rubber spring 250 about hinge pin 289, compressing the material of the rubber spring and moving the two ends 252 and 254 of the spring closer together. A tension is formed in the spring 250 that tends to urge the lever 215 to pivot and move the control structure 237 back to the locked position in similar fashion to the springs of the previously described embodiments. It should be understood that the tension in the rubber spring 250 results both from moving the ends of the spring closer together and from compressing the material of the spring.

Figure 14:
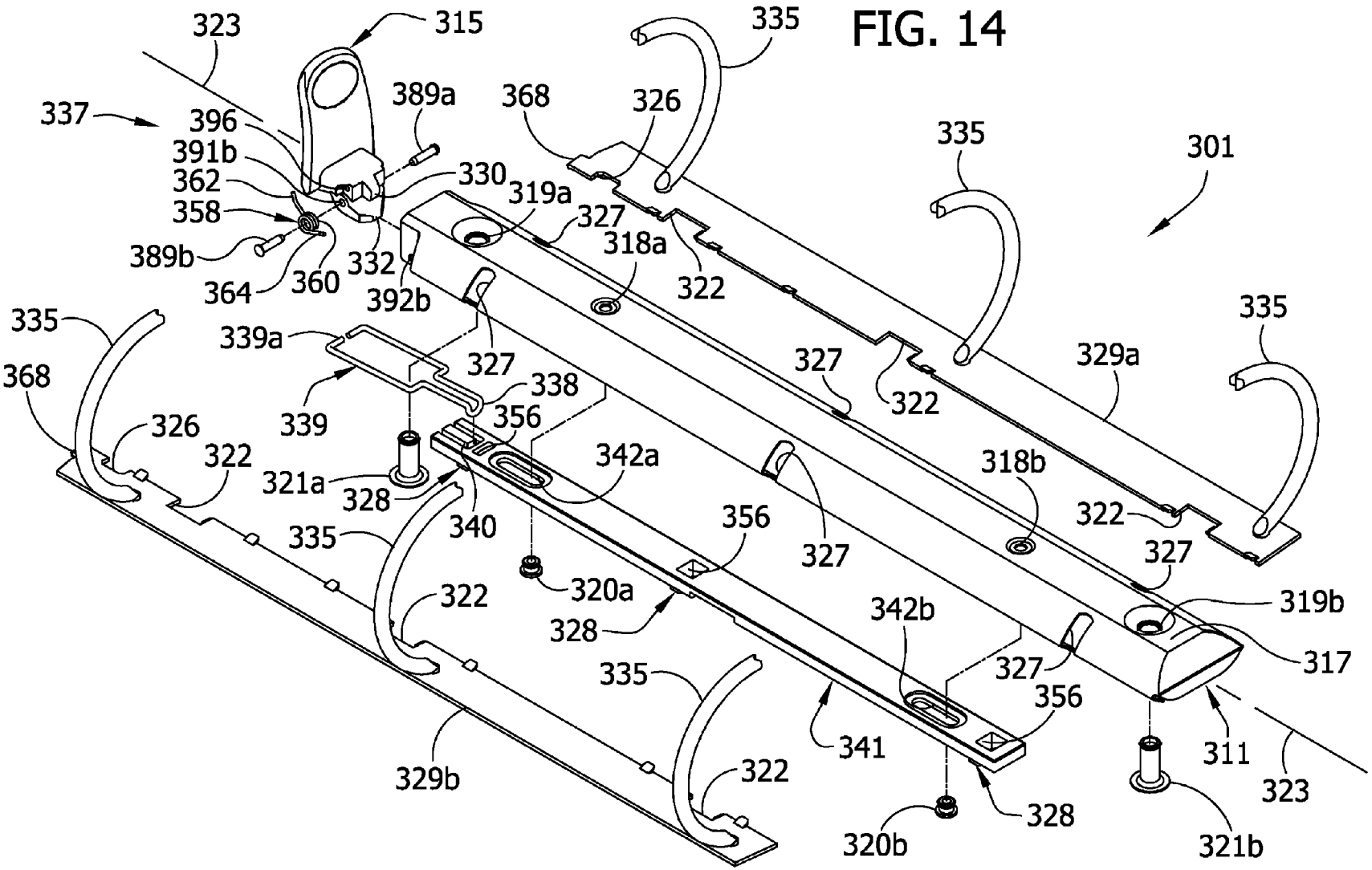
FIG. 14 is an exploded perspective of a ring binder mechanism according to a fourth embodiment of the invention.

FIGS. 14-17B show a forth embodiment of the ring binder mechanism generally at reference numeral 301. The mechanism of this embodiment is again similar to the mechanism 1 of the first embodiment, and parts of this mechanism 301 corresponding to parts of the mechanism of the first embodiment are designated by the same reference numerals, plus "300". As shown in FIG. 14, housing 311 of this embodiment includes two additional openings 318*a* and 318*b* in plateau 317, located relatively inward from openings 319*a* and 319*b*, respectively, for receiving and attaching grooved mounting rivets 320*a* and 320*b* to the housing 311, the purpose of which will be explained hereinafter. Also in this embodiment, hinge plates 329*a* and 329*b* include four pairs of aligned cutouts along their inner edge margins; cutouts of three pairs are indicated by reference numeral 322 and cutouts of one pair by reference numeral 326, each pair of cutouts serving a purpose that will become apparent hereinafter. Outer edge margins of the hinge plates 329*a* and 329*b* are free of cutouts, and in the illustrated embodiment, ring members 335 of each ring 313 mount on upper surfaces of the hinge plates.

Control structure 337 of this embodiment is also shown in FIG. 14 and is modified compared to that of the previous embodiments to include three blocking elements, each designated generally by reference numeral 328. In addition, lever 315 of the control structure 337 is bowed generally away from the housing 311 and includes a closing arm 330 and an opening arm 332. The closing arm and opening arm extend away from the lever 315 and are generally vertically opposed to one another. The arms 330 and 332 may be integral with the lever 315 or may be attached separately, and a mechanism having a lever shaped differently than illustrated does not depart from the scope of the invention.

As also seen in FIG. 14, the intermediate connector 339 is located between the lever 315 and travel bar 341 and is illustrated as a wire bent into an elongate, rectangular form. One end 339*a* of the connector 339 is open and the other end includes an elongate, rectangular extension 338 protruding therefrom that is narrower than the connector itself. The travel bar 341 extends away from the intermediate connector 339 lengthwise of the housing 311 and in line with longitudinal axis 323 of the housing. The travel bar 341 is relatively flat and elongate and includes a channel 340 in its upper surface at one longitudinal end. Two elongate openings 342*a* and

342*b* are formed at recessed positions in the travel bar 341. The elongate openings 342*a* and 342*b* slidably receive the grooved mounting rivets 320*a* and 320*b* therethrough. Mounts 356 in the top of the travel bar 341 are formed when making the travel bar. The illustrated travel bar 341 is formed by an injection mold process. But it could be formed by a different process without departing from the scope of the invention.

Still referring to FIG. 14, a coiled torsion spring 358 is included in this embodiment adjacent the lever 315. The spring 358 is similar to the torsion spring 45 of the first embodiment, but is located toward a bottom of the lever 315, near the closing and opening arms 330 and 332 and toward one side of the lever. It includes a coiled body 360 and two arms 362 and 364, and its interaction with the control structure 337 will be described in further detail hereinafter.

Figure 15:
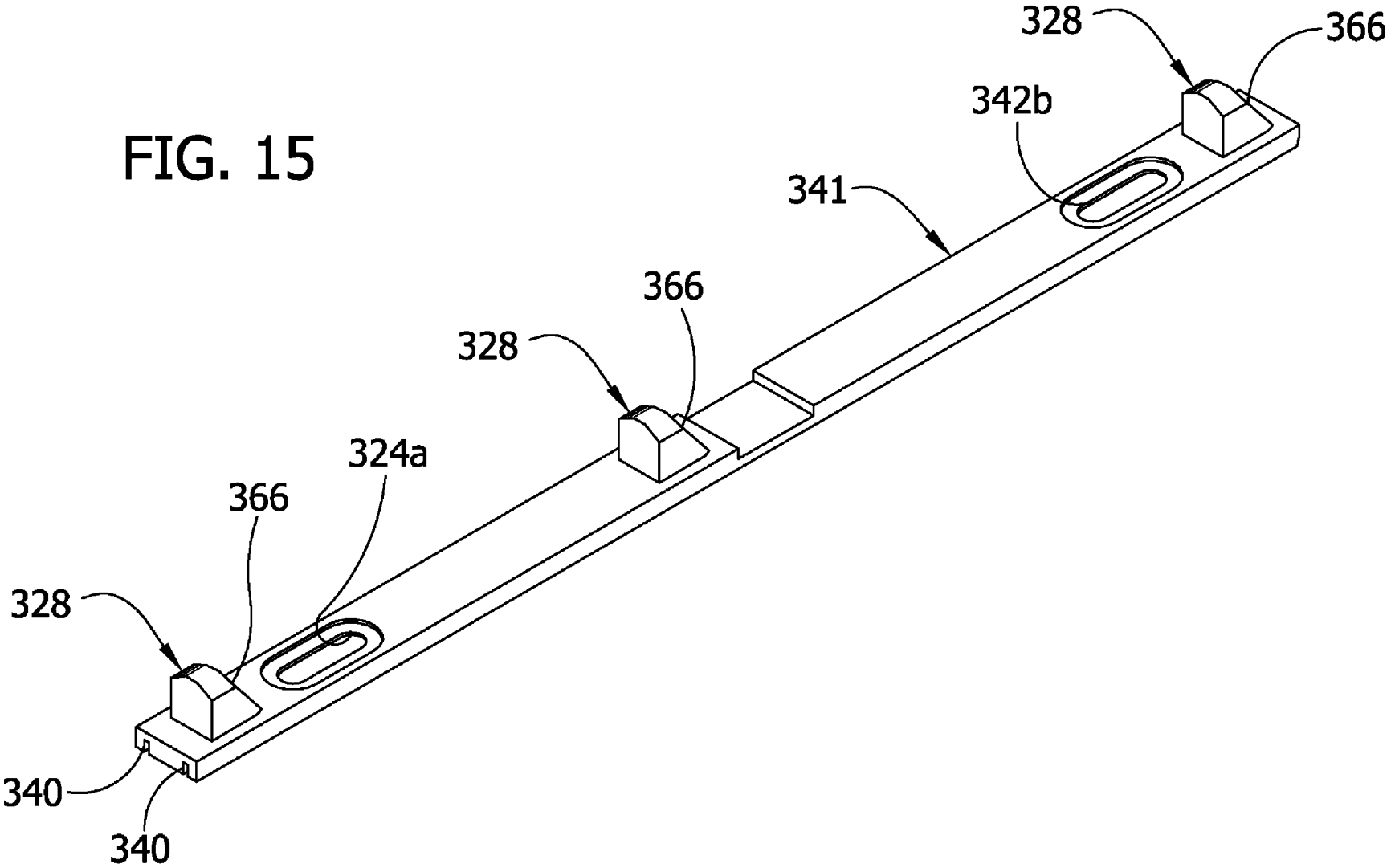
FIG. 15 is a bottom perspective of a travel bar of the mechanism.

Referring now to FIG. 15, the three blocking elements 328 can be seen uniformly spaced along the bottom of the travel bar 341. The blocking elements 328 are formed as one piece with the travel bar 341, but could be formed separately without departing from the scope of the invention. Surfaces 366 of the blocking elements 328, facing away from the travel bar channel 340, are angled, the reason for which will be described in greater detail hereinafter. Blocking elements shaped differently than illustrated do not depart from the scope of the invention.

Figure 16A:
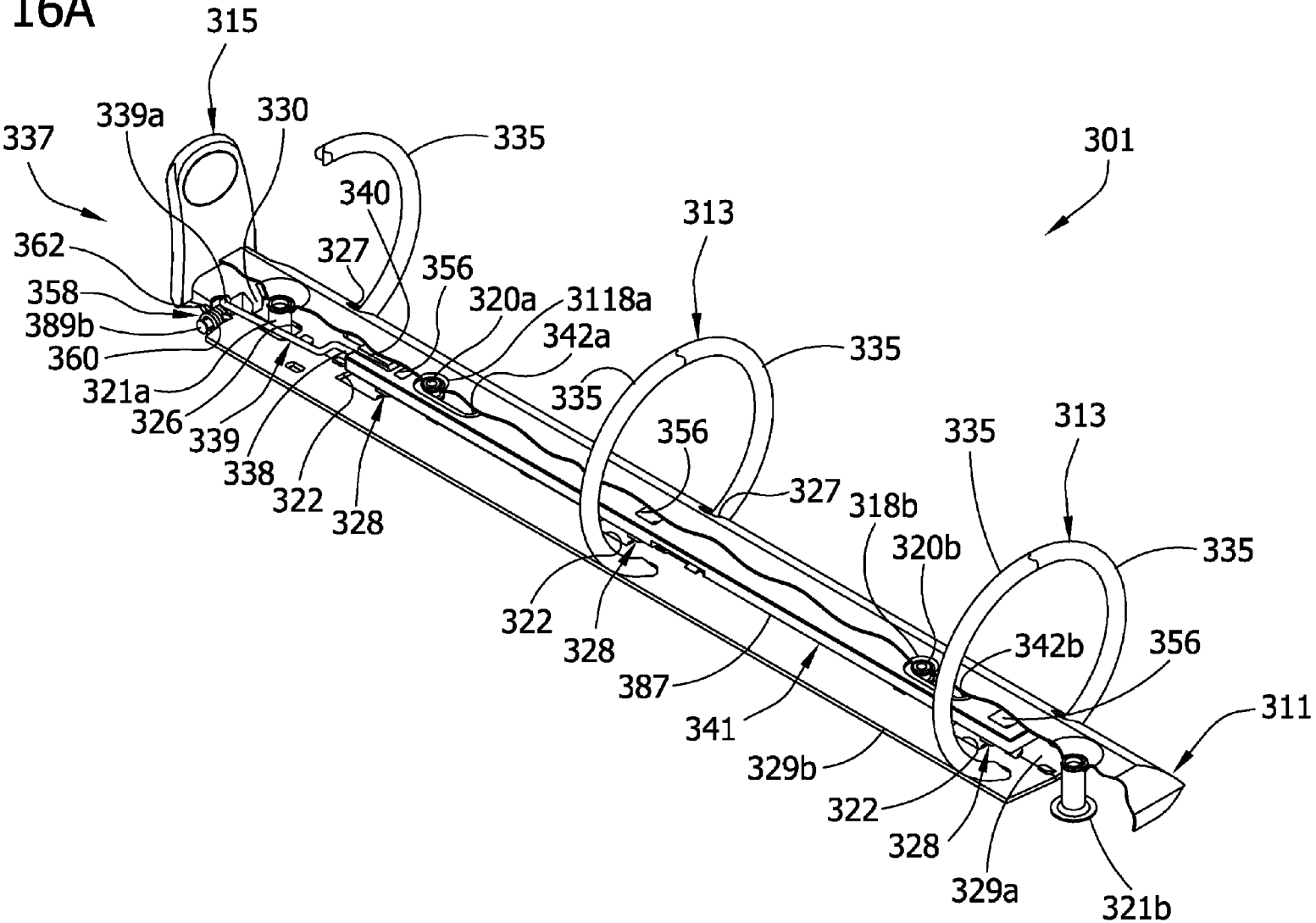
FIG. 16A is a perspective of the mechanism of FIG. 14 with a portion of a housing cut away and one ring member removed to show internal construction of the mechanism at a closed and locked position.
Figure 16B:
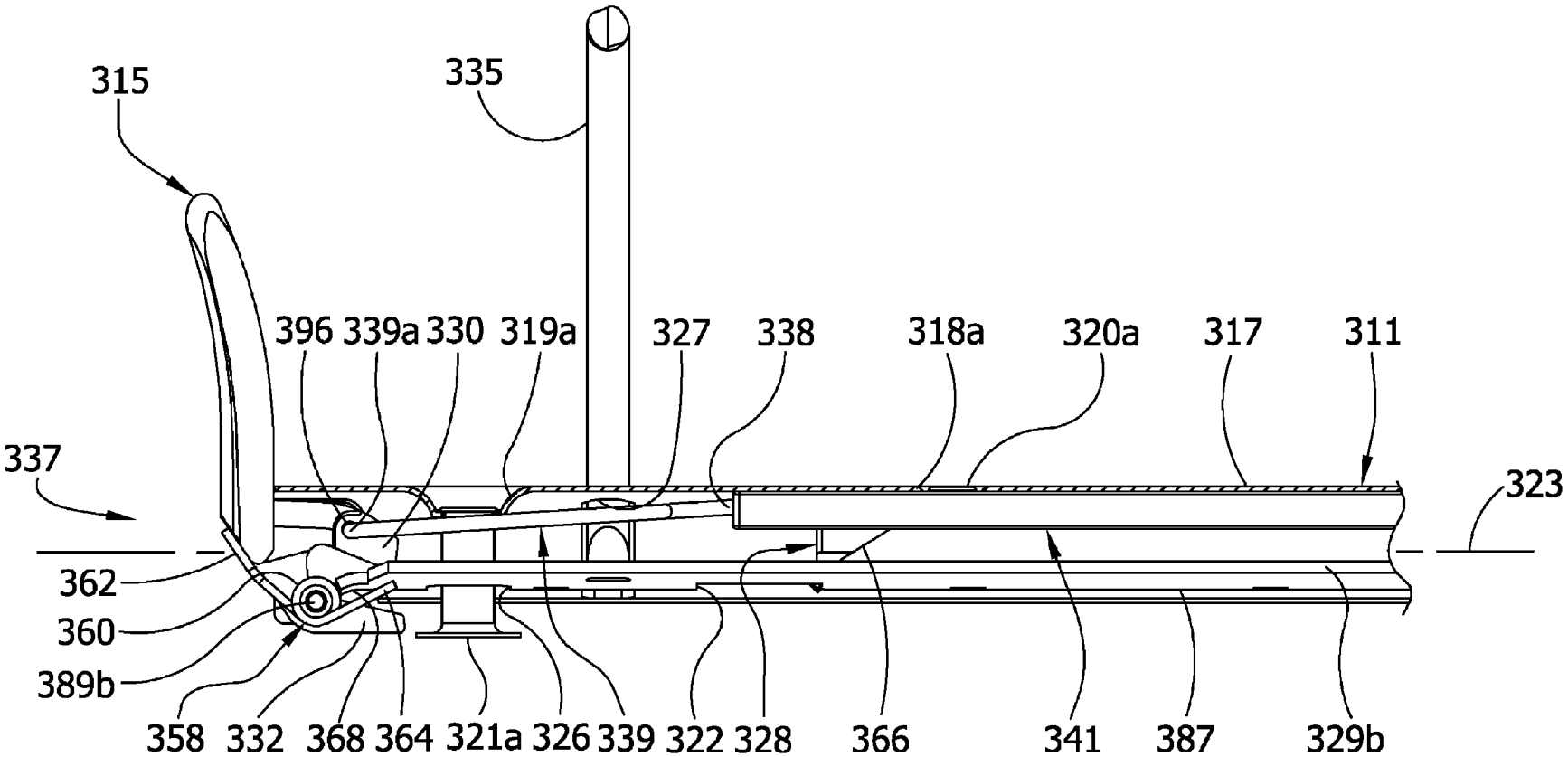
FIG. 16B is an enlarged and fragmentary side elevation thereof.

Referring now to the ring binder mechanism 301 in assembled form, and in particular that illustrated in FIGS. 16A and 16B, the lever 315 is pivotally mounted on the housing 311 by hinge pins 389*a* and 389*b* (only pin 389*b* is visible) through holes 391*a* and 391*b* of the lever (see FIG. 14, only hole 391*b* is visible) and holes 392*a* and 392*b* of the housing (again see FIG. 14, only hole 392*b* is visible). As best shown in FIG. 16B, fingers 368 of the hinge plates 329*a* and 329*b* fit between the closing and opening arms 330 and 332 of the lever 315, while the open end 339*a* of the intermediate connector 339 is received in apertures 396 in the closing arm 330 of the lever 315. The extension 338 of the connector 339 is received in the travel bar channel 340 (FIG. 16A).

Referring now particularly to FIG. 16A, the grooved mounting rivets 320*a* and 320*b* slidably connect the travel bar 341 to the housing 311 through the recessed slots 342*a* and 342*b* of the travel bar and the additional openings 318*a* and 318*b* in the housing plateau 317. The blocking elements 328 face the hinge plates 329*a* and 329*b* and are generally aligned with the hinge 387 of the interconnected plates at locations adjacent openings formed by cutouts 322 and adjacent ring members 335. A first mounting post 321*a* passes through the hinge plates 329*a* and 329*b* and intermediate connector 339 at an opening formed by cutouts 326 near the lever 315. This mounting post 321*a*, along with mounting post 321*b*, acts to secure the mechanism 301 to a cover of a binder (not shown).

FIGS. 16A and 16B also illustrate orientation of the torsion spring 358 relative to the control structure 337. As can be seen, the torsion spring 358 is connected to the housing 311 by hinge pin 389*b*, which also mounts lever 315 on housing 311, through the coiled body 360 of the spring. The first free end 362 of the torsion spring 358 engages an outer side of the lever 315 while the second free end 364 engages the underside of hinge plate 329*b*. The torsion spring 358 is oriented to resist movement of the lever 315 tending to move the control structure 337 to open the ring members 335. In particular, the torsion spring 358 resists pivoting movement of the lever 315 outward and downward (i.e., movement of the first end 362 of the spring counterclockwise away from the second end 364), which, as will be described in greater detail hereinafter, operates to open the ring members 335.

Operation of the mechanism 301 of this embodiment can be seen with reference to FIGS. 16A-17B. As in the previous embodiments, the control structure 337 selectively moves the ring members 335 between the closed and open positions. When the ring members are in the closed position as shown in FIGS. 16A and 16B, the mechanism 301 is locked and the blocking elements 328 are positioned between the hinge plates 329*a* and 329*b* and travel bar 341, substantially out of registration with the hinge plate cutout openings 322. The blocking elements 328 are in contact with an upper surface of the hinge plates and, together with travel bar 341, effectively block pivoting motion of the hinge plates tending to open the ring members 335.

Figure 17A:
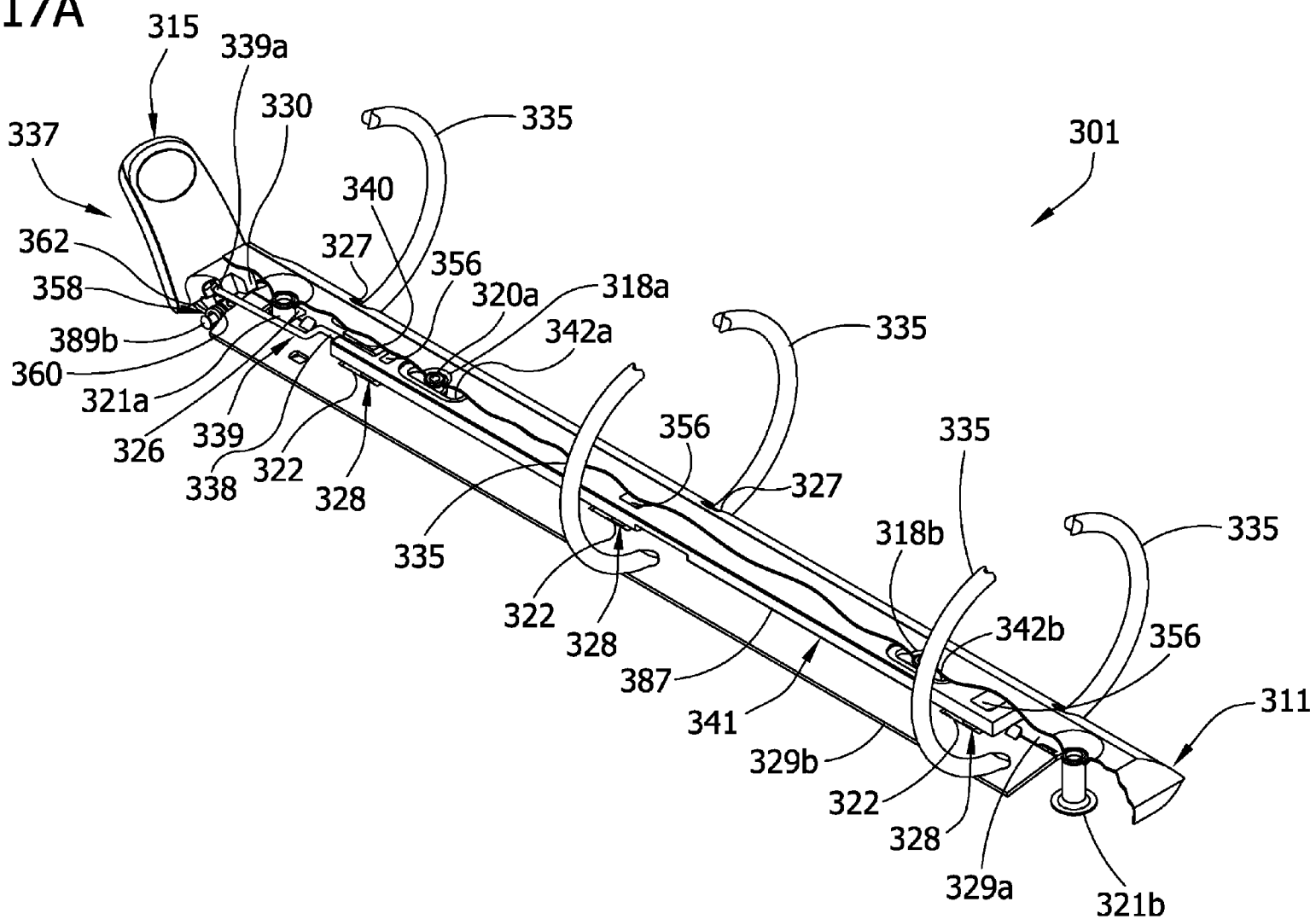
FIG. 17A is a perspective similar to FIG. 16A with the mechanism at an open position.
Figure 17B:
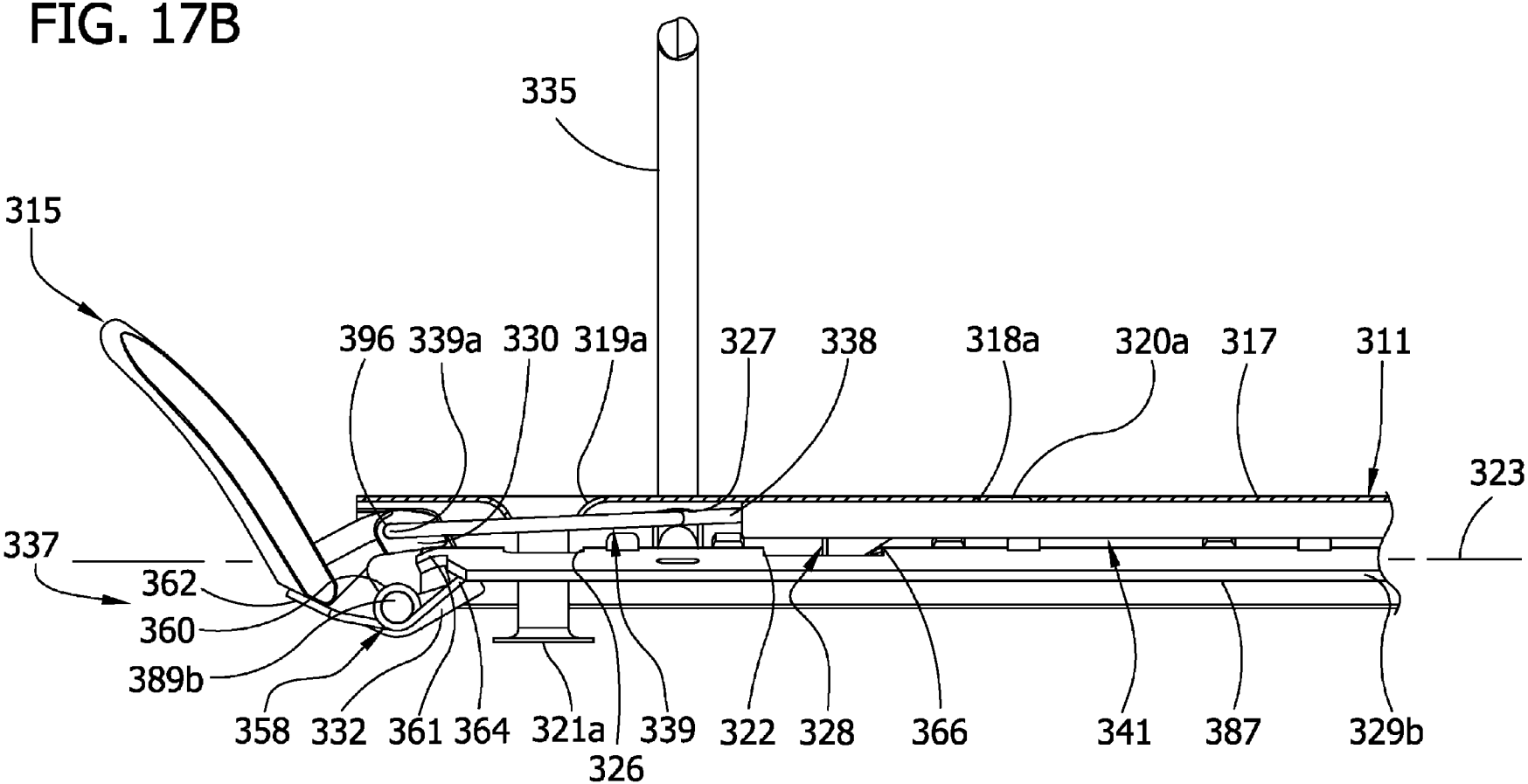
FIG. 17B is an enlarged and fragmentary side elevation thereof.

To move the ring members 335 to the open position shown in FIGS. 17A and 17B, an operator progressively pivots the lever 315 outward and downward. This pulls the intermediate connector 339 and travel bar 341 toward the lever 315. The blocking elements 328 move out of their position blocking pivoting motion of the hinge plates 329*a* and 329*b* and into registration with the hinge plate cutout openings 322. The first free end 362 of the torsion spring 358 moves with the lever 315 away from the second free end 364 of the spring (producing tension in the spring) and the opening arm 332 of the lever engages the underside of the hinge plates 329*a* and 329*b*. During this initial opening operation, torsion spring 358 tends to resists the lever movement and, if the lever is released before the ring members 335 open (i.e., before the hinge plates pivot upward through the co-planar position and overcome the spring force of the housing), the spring will automatically urge the lever 315 back to the upright position, pushing the intermediate connector 339, travel bar 341, and blocking elements 328 back to the locked position (FIGS. 16A and 16B).

As the operator continues to pivot the lever 315, the opening arm 332 biases the hinge plates 329*a* and 329*b* to pivot upward toward the housing 311, and through the co-planar position of the plates (overcoming the housing spring force holding the plates in the closed position). The hinge plate cutout openings 322 pass over the corresponding blocking elements 328 and the ring members 335 open. In this open position, the torsion spring 358 still tends to urge the lever 315 to pivot upward and inward for closing the ring members 335 and moving the travel bar 341 and blocking elements 328 toward the locked position. This lever movement is resisted, though, by the hinge plates 329*a* and 329*b* being held in their upwardly hinged position by the spring force of the housing 311. Specifically, the closing arm 320 of the lever 315 engages fingers 368 of the hinge plates 329*a* and 329*b*, which hold the lever against further pivoting movement by the torsion spring 358 (FIG. 17B). In addition, a portion of the angled surface 366 of each blocking element 328 frictionally engages a portion of the hinge plates 29*a* and 29*b* at the respective hinge plate cutout opening 332, helping to hold the lever against further pivoting movement (FIG. 17B).

To close the ring members 335 and return the mechanism 301 to the locked position (FIGS. 16A and 16B), the operator may either pivot the lever 315 upward and inward or manually push the ring members 335 together. Either action requires overcoming the spring force of the housing 311 holding the ring members open. If the operator pivots the lever 315, the closing arm 330 engages the upper surfaces of hinge plates 329*a* and 329*b* and pivots them downward, through the co-planar position, and over blocking elements 328. As soon as the hinge plates 329*a* and 329*b* pass through the co-planar position and the angled surfaces 366 of the blocking elements 328 clear the forward edges of the cutout openings 322, the torsion spring 358 immediately contracts and automatically urges the lever 315 to pivot toward its upright position. This pushes the travel bar 341 and blocking elements 328 away from the lever 315 back to the locked position. Similarly, if the ring members 335 are manually pushed together, the hinge plates 329*a* and 329*b* directly pivot downward and through the co-planar position, pushing the opening arm 332 downward and moving the cutout openings 322 over the corresponding blocking elements 328. The torsion spring 358 immediately contracts and automatically urges the lever 315 to pivot toward its upright position, pushing the travel bar 341 and blocking elements 328 back to the locked position.

Figure 18:
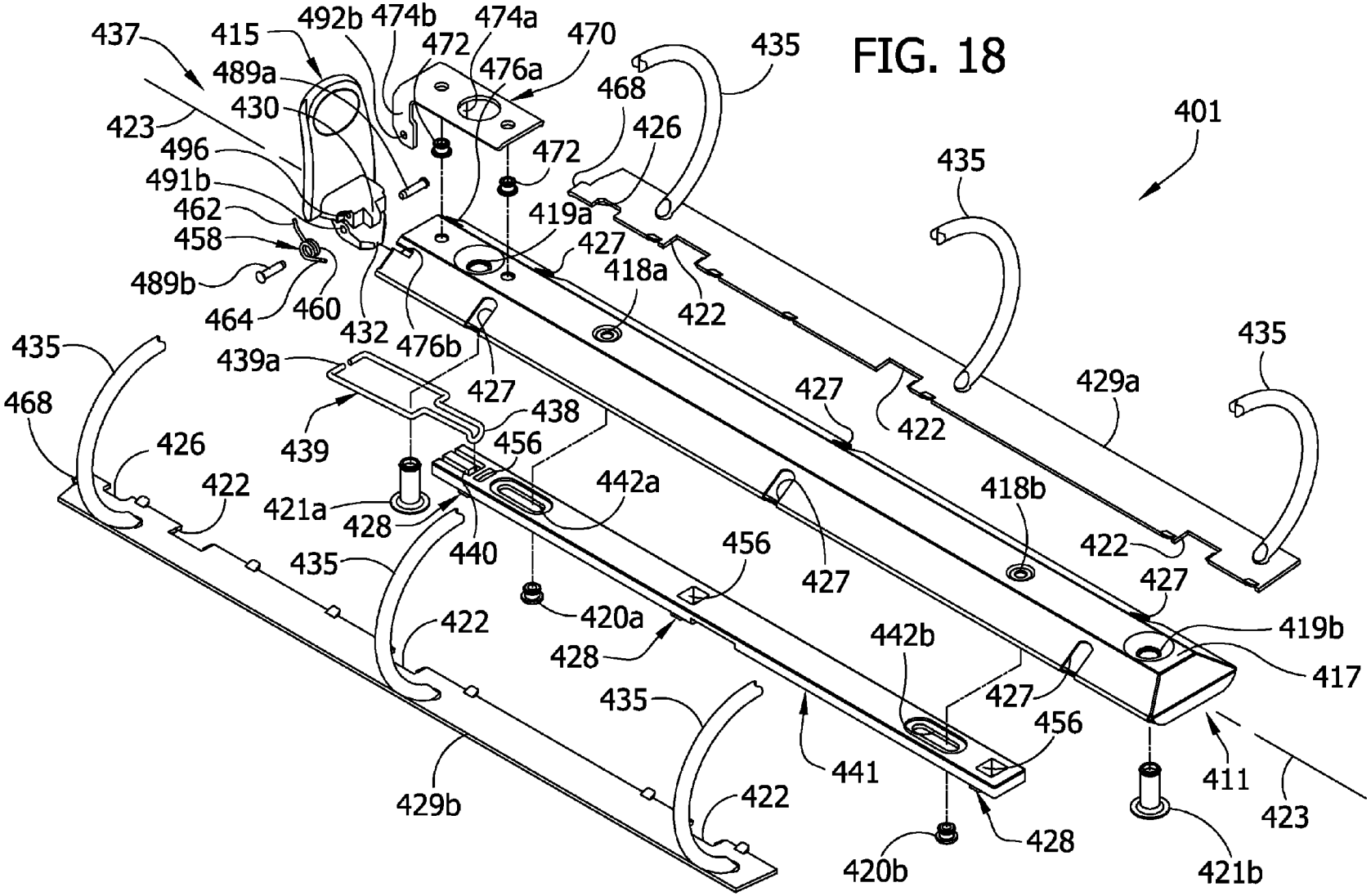
FIG. 18 is an exploded perspective of a ring binder mechanism according to a fifth embodiment of the invention.
Figure 19:
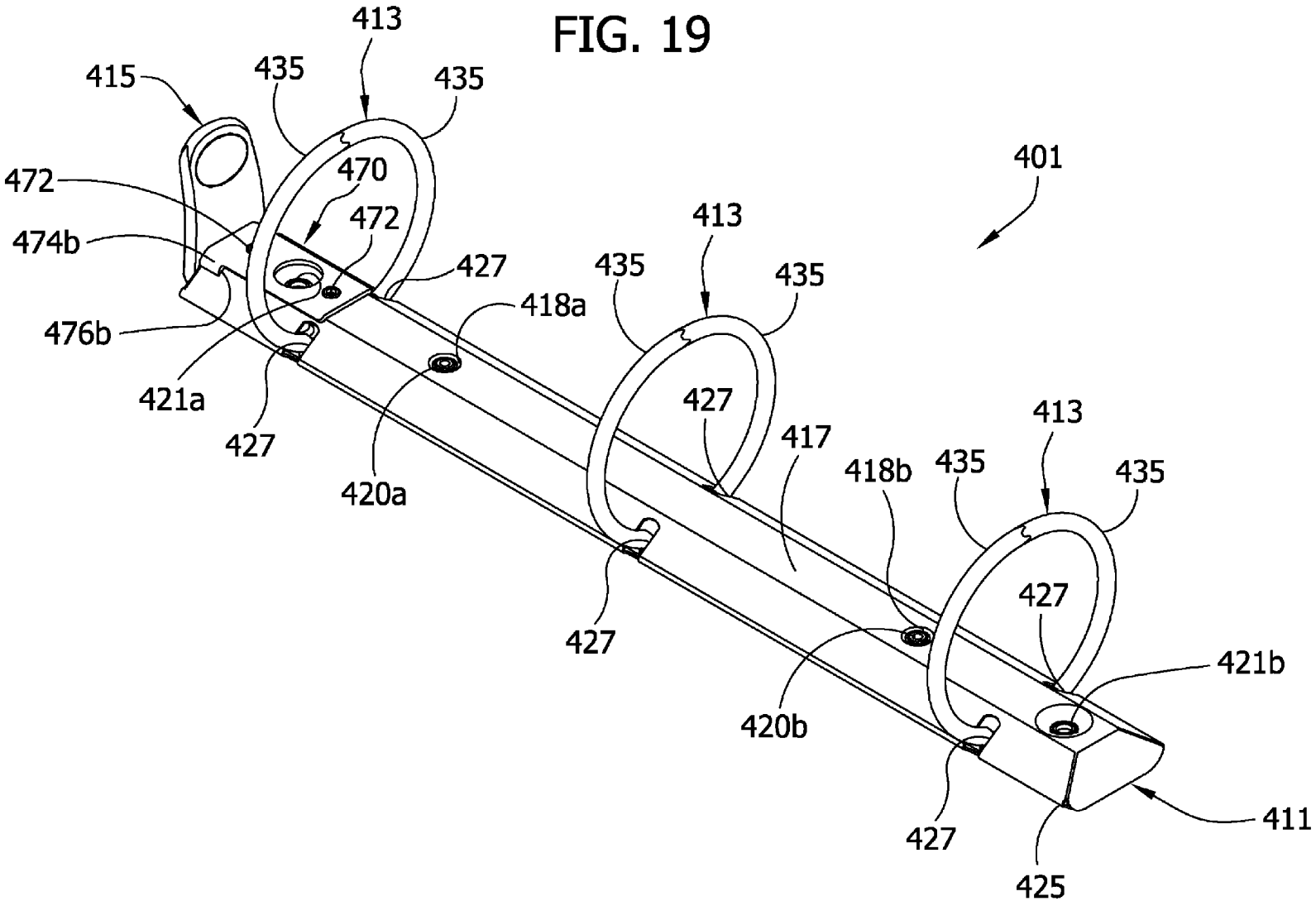
FIG. 19 is a perspective of the mechanism of FIG. 18 at a closed and locked position.

FIGS. 18 and 19 illustrate a ring binder mechanism according to a fifth embodiment of the invention shown generally at reference numeral 401. This mechanism is substantially the same as the mechanism 301 of the fourth embodiment, and parts of the mechanism 401 of this embodiment corresponding to parts of the mechanism 301 of the fourth embodiment are designated by the same reference numerals, plus "100". In this mechanism 401, lever 415 is mounted on housing 411 by a lever mount, designated generally by reference numeral 470, formed as a separate piece from the housing. As can be seen in FIG. 19, the lever mount 470 is connected to the housing 411 by rivets 472 so that arms 474*a* and 474*b* of the mount fit in slots 476*a* and 476*b* of the housing. In all other aspects, the mechanism 401 is the same as the mechanism 301 of the fourth embodiment.

Figure 20:
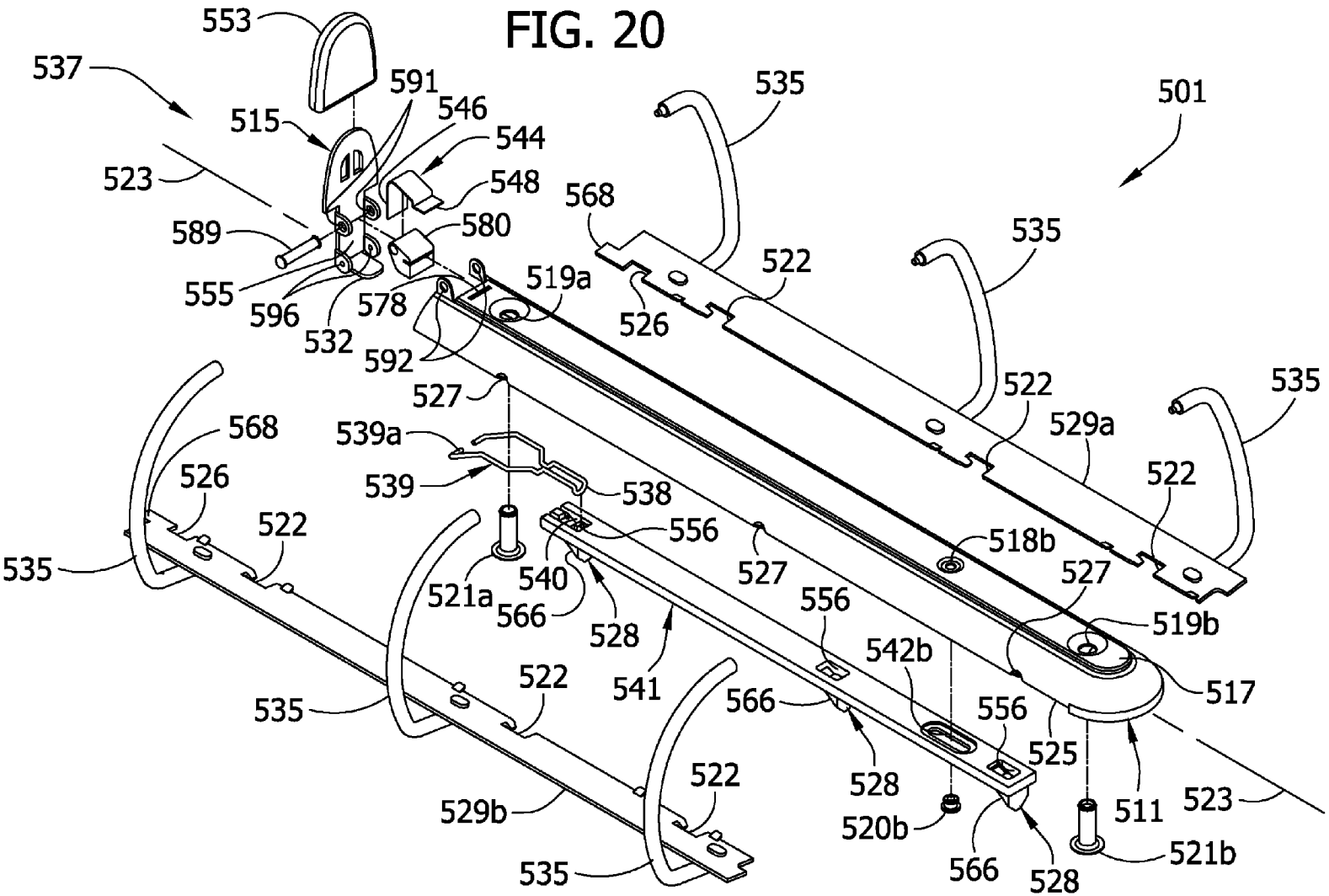
FIG. 20 is an exploded perspective of a ring binder mechanism according to a sixth embodiment of the invention.

A sixth embodiment of the ring binder mechanism of the invention is shown in FIGS. 20-24 generally at reference numeral 501. The mechanism of this embodiment is similar to the mechanism 301 of the fourth embodiment, and parts of this mechanism 501 corresponding to parts of the mechanism 301 of the fourth embodiment are designated by the same reference numerals, plus "200". As shown in FIG. 20, in this mechanism 501 housing 511 includes one additional opening 518*b* in housing plateau 517, located relatively inward from opening 519*b* for receiving and attaching grooved mounting rivet 520*b* to the housing 511 to support movement of travel bar 541 lengthwise of the housing. In addition, the housing 511 includes a slit 578 adjacent lever 515, the purpose for which will be described in further detail hereinafter. As also shown in FIG. 20, ring members 535 of each ring 513 mount on an underside of hinge plates 529*a* and 529*b* and are shaped to form a generally D-shape when in the closed position (not shown).

The actuating lever 515 of this mechanism 501 is also illustrated in FIG. 20 and includes an enlarged head 553 extending from a narrow body 555. A flat opening arm 532 is located toward a bottom of the lever body 555, extending away from the body, and may be integral with the lever body 555 or may be attached to the lever body. A mechanism having a lever or opening arm shaped differently than illustrated does not depart from the scope of the invention. Also in this mechanism 501, the intermediate connector 539 located between the lever 515 and travel bar 541 is bent downward at the open end 539*a*, while the travel bar, which extends away from the connector 539, includes one elongate opening 542*b* recessed into its top and bottom surfaces generally at a location corresponding to the location of the additional opening 518*b* in the housing plateau 517. In addition, a spring plate, designated generally at reference numeral 544, and a core 580 interact with the lever 515 for urging it to move control structure 537 to the closed and locked position. The spring plate 544 is substantially similar to the spring plate 144 described for the mechanism 101 of the second embodiment, while the core 580 is generally a solid mass of plastic or hard rubber, or other similar generally rigid material capable of supporting the spring plate for pivoting movement.

Figure 21:
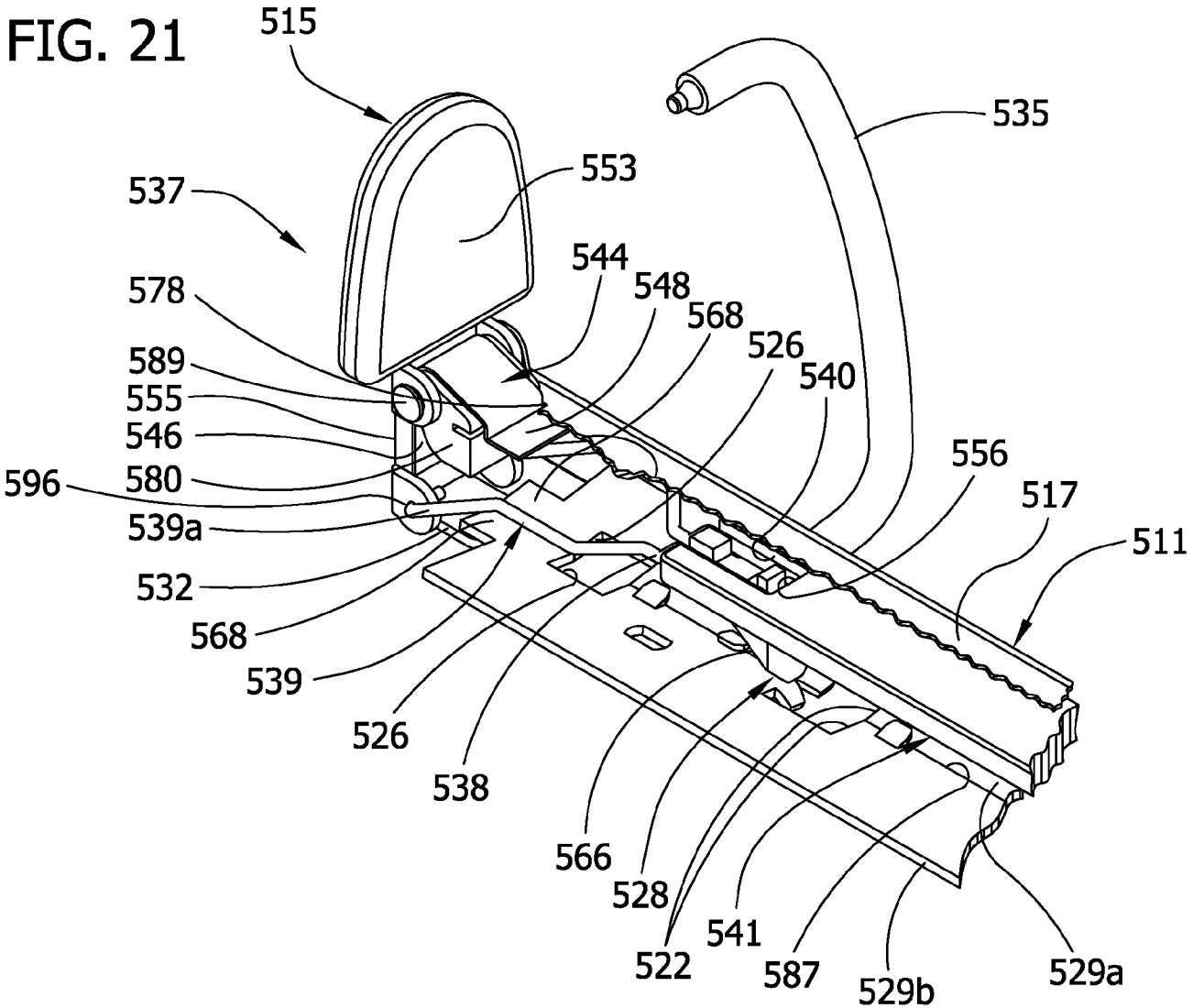
FIG. 21 is an enlarged fragmentary perspective of the mechanism of FIG. 20 with a portion of a housing and a first ring member of a ring removed to show internal construction of the mechanism at a closed and locked position.
Figure 22:
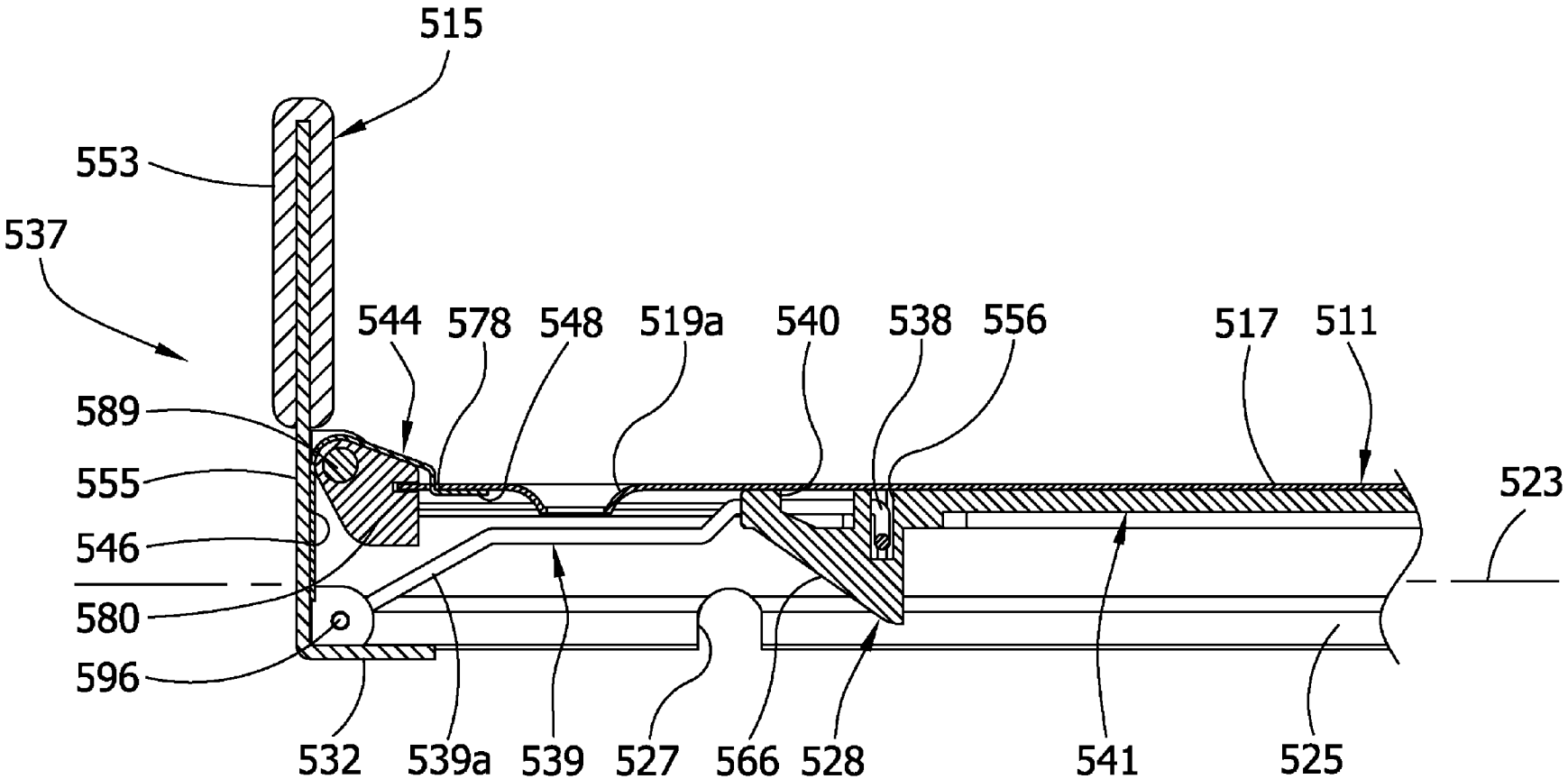
FIG. 22 is an enlarged fragmentary longitudinal section of the mechanism with hinge plates and ring members removed.
Figure 23:
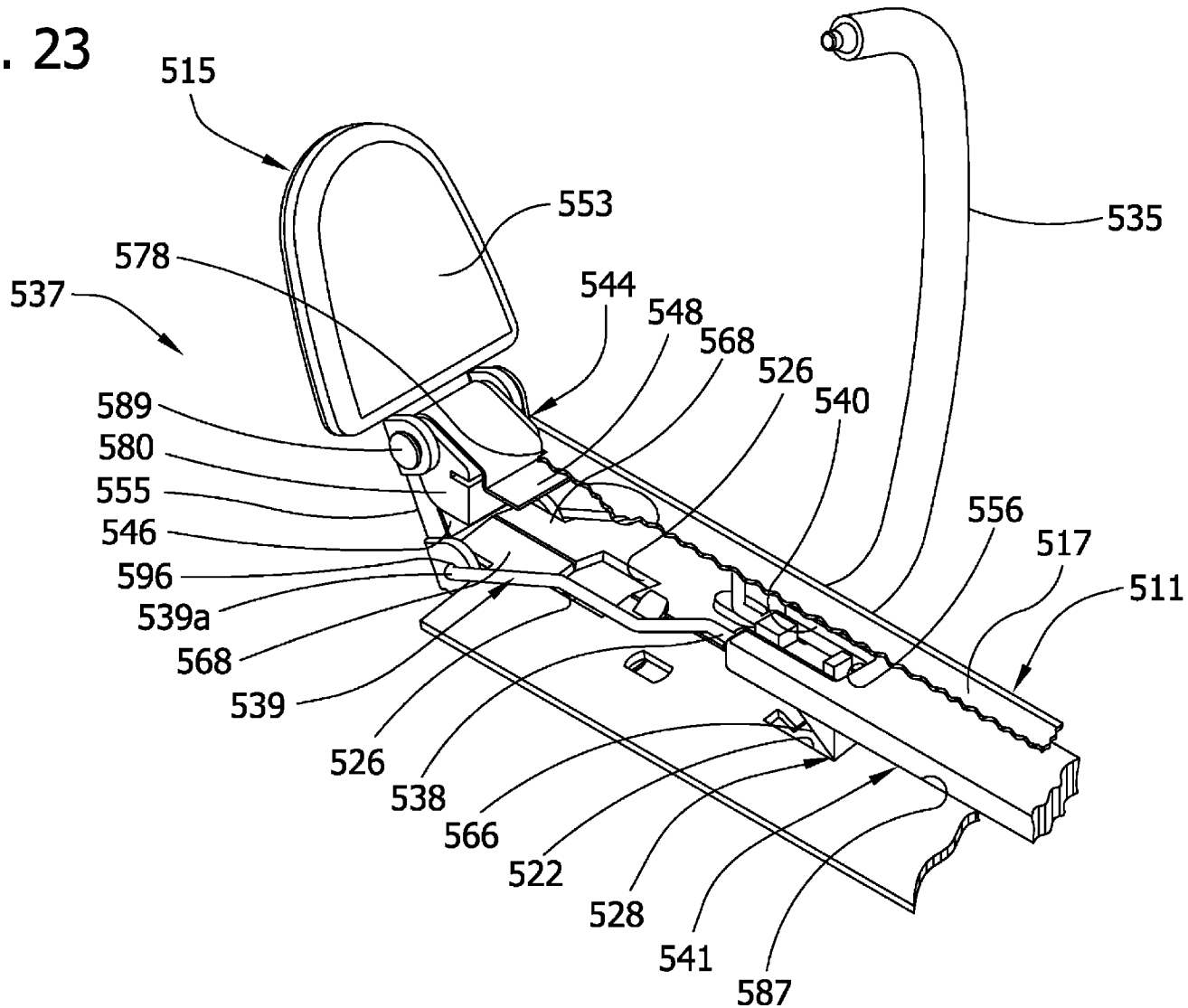
FIG. 23 is a view similar to FIG. 21 with the mechanism at an open position.
Figure 24:
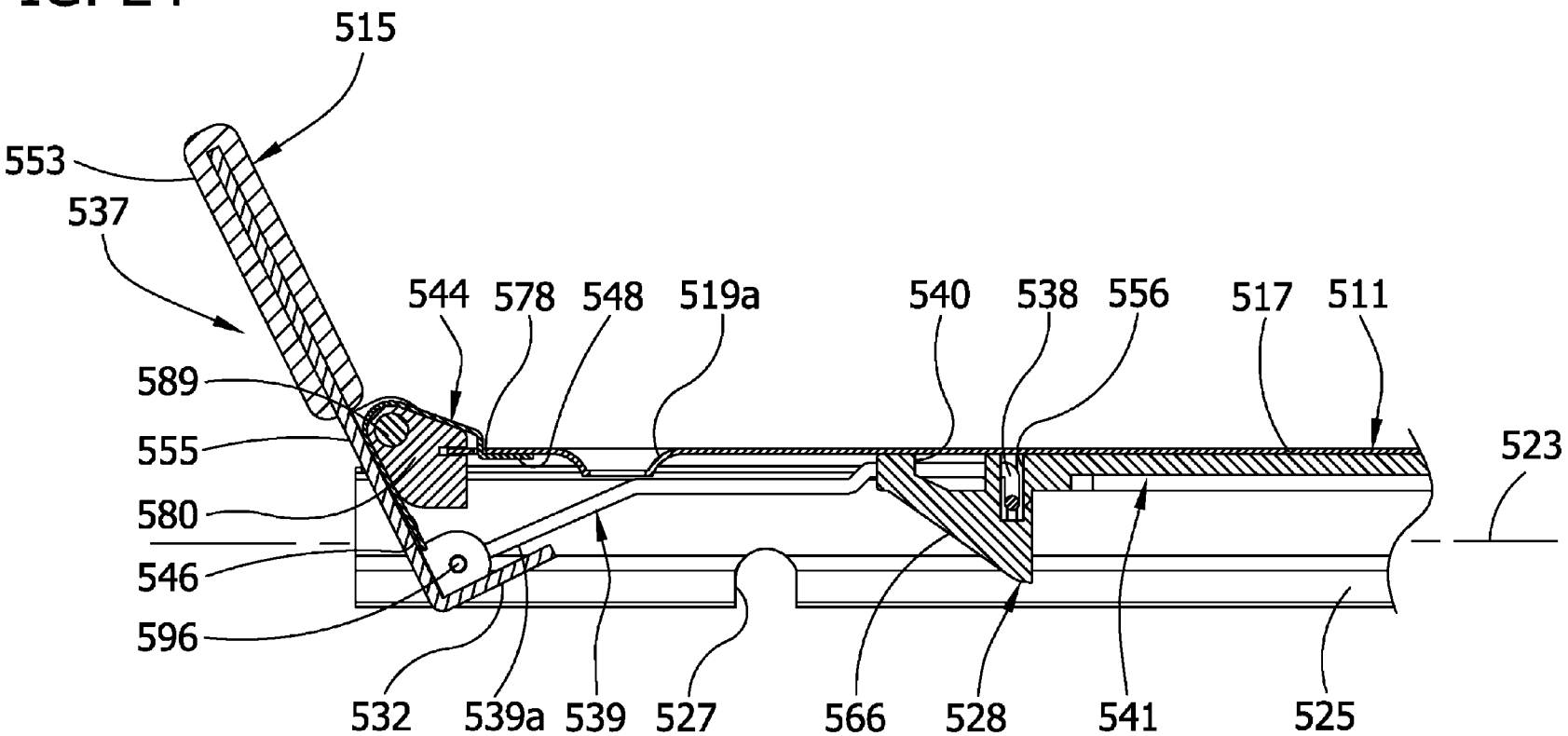
FIG. 24 is a section similar to the section shown in FIG. 22 but with the mechanism at the open position.

Referring now to the assembled ring binder mechanism 501 fragmentally shown in FIGS. 21-24, the lever 515 is pivotally mounted on the housing 511 by hinge pin 589 through holes 591 of the lever and holes 592 of the housing (see FIG. 20). As best seen in FIG. 21, the opening arm 532 is positioned under the hinge plates 529*a* and 529*b*, and the open end 539*a* of the intermediate connector 539 is received in lower openings 596 of the lever 515 (only one opening 596 is visible). The opposite, narrow extension 538 of the connector 539 is received in the square-shaped channel 540 of the travel bar 541. The blocking elements 528 are below the travel bar 541, generally facing the hinge plates 529*a* and 529*b*, and are aligned with the hinge 587 of the interconnected plates at locations along the hinge adjacent cutout openings 522 and generally adjacent the ring members 535. The angled surfaces 566 of the blocking elements 528 face the lever 515. The core 580 is connected to the housing 311 by hinge pin 589 through an opening in the core. A forward notch in the core 580 fits over upper plateau 517 of the housing 511 for providing additional support to the core. The spring plate 544 mounts on the core 580 for operation with the first free end 546 of the spring plate engaging the lever body 555 and the second free end 548 fitting through the slit 578 in the housing plateau 517 for retention thereunder.

Operation of the mechanism 501 can be seen also with reference to FIGS. 21-24 and is substantially the same as operation of the mechanism 301 of the fourth embodiment. An important distinction is use of the core 580 and spring plate 544 to urge the lever 515 to pivot and move the control structure 537 to a locked position. In addition, when an operator pivots the lever 515 to open the ring members 535 and unlock the mechanism 501, the intermediate connector 539, travel bar 541, and blocking elements 528 move away from the lever 515. Opening arm 532 of lever 515 engages an underside of hinge plates 529*a* and 529*b* and initiates pivoting movement of the plates upward and through the co-planar position (i.e., to open the ring members 535). During this opening operation, the spring plate 544 pivots about core 580 which acts as a pivot support for the spring plate. The first free end 546 of the spring plate 544 moves with the lever 515 in a direction generally toward the second free end 548 of the spring plate. The ring members 535 open when the hinge plates 529*a* and 529*b* pass through the co-planar position, similar to opening operation of the fourth embodiment. If the lever is released before the ring members open (and before the hinge plates move upward through the co-planar position), the spring plate 544 urges the lever to pivot and move the control structure 537 back to the locked position.

Once the ring members 535 of this mechanism 501 are in the open position, tension in the spring plate 544 tends to urge the lever 515 to pivot for moving the control structure 537 to close the ring members and lock the mechanism. But this is resisted by the hinge plates 529*a* and 529*b*, which are held in an upwardly hinged position by the spring force of the housing 511. In particular, a portion of angled surface 566 of each blocking element 528 engages a portion of hinge plates 529*a* and 529*b* at each corresponding cutout opening 522 of the plates. The hinge plates 529*a* and 529*b*, under the spring force of the housing 511, resist the cam force of the angled surfaces 566 of the blocking elements 528 and thus resist the urging force of the spring plate 544 to further pivot the lever.

To close the ring members 535 and lock the mechanism 501, the operator may pivot the lever 515 upward and inward or may manually push the ring members 535 together. Pivoting the lever 515 pulls the intermediate connector 539 and travel bar 541 toward the lever and causes the angled surfaces 566 of the blocking elements 528 to cam the hinge plates 529*a* and 529*b* downward and through the co-planar position (overcoming the spring force of the housing). As soon as the hinge plates 529*a* and 529*b* pass though the co-planar position and the blocking elements 528 clear the forward edges of the cutout openings of the plates, the spring plate 544 immediately expands and automatically pivots the lever 515 to its upright position, which in turn pushes the travel bar 541 and blocking elements 528 back to the locked position.

Figure 25:
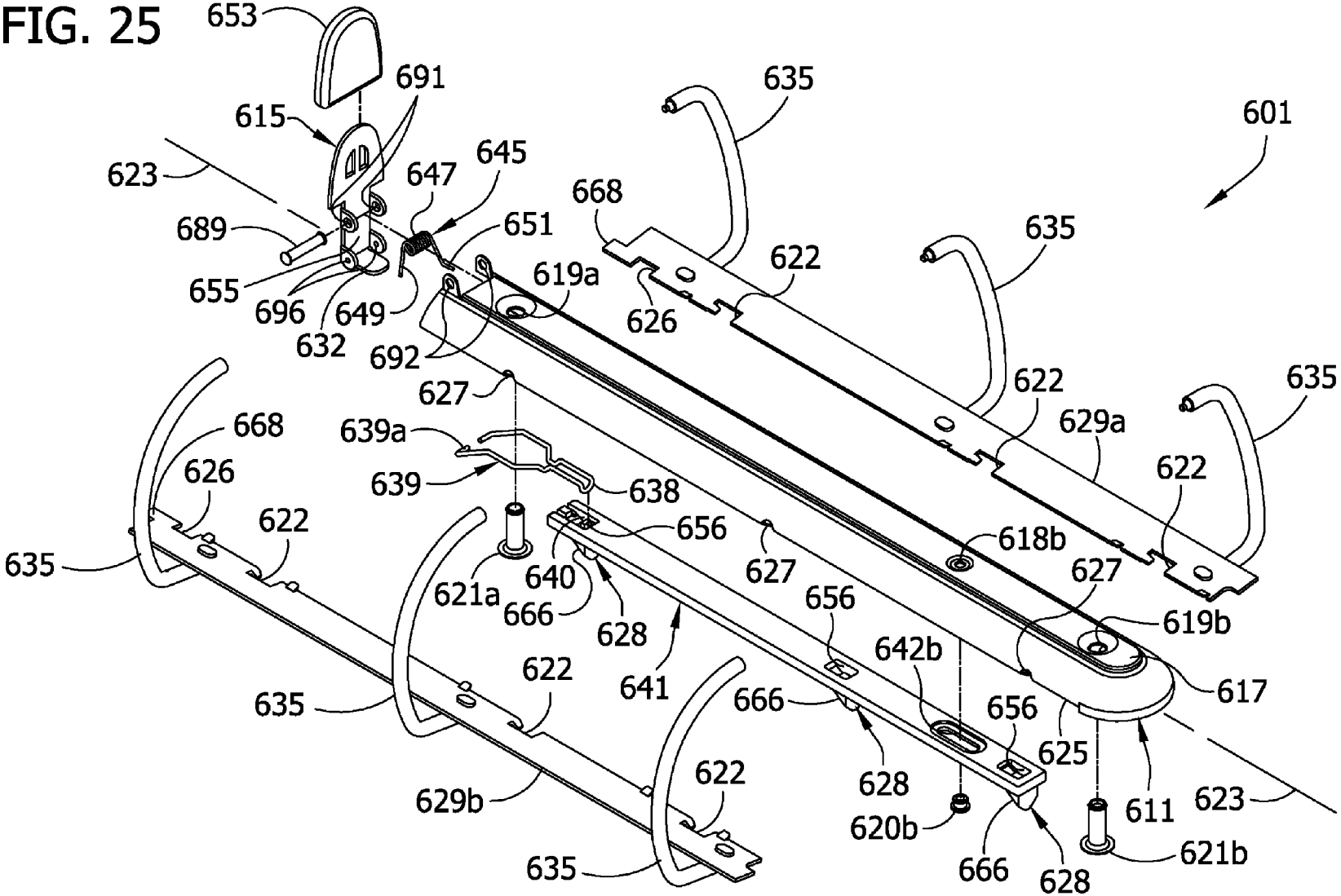
FIG. 25 is an exploded perspective of a ring binder mechanism according to a seventh embodiment of the invention.

A seventh embodiment of the ring binder mechanism of the invention is shown generally at reference numeral 601 in FIG. 25. This mechanism is substantially similar in operation and structure to the mechanism 501 of the sixth embodiment, and parts of the mechanism 601 of this embodiment corresponding to parts of the mechanism of the sixth embodiment are designated by the same reference numerals, plus "100". In addition in this mechanism 601, a torsion spring 645 substantially identical to that of the first embodiment is connected to the housing 611 by hinge pin 689 through openings 692 in the housing for urging the control structure 637 to the closed and locked position. The first free end 649 of the torsion spring 645 engages the lever 615 while the second free end 651 engages the housing 611 at its plateau 617. Pivoting movement of the lever 615 outward and downward moves the two ends 649 and 651 of the torsion spring 645 closer together and creates a tension in the spring tending to urge the lever back to the full, upright, and locked position.

Figure 26:
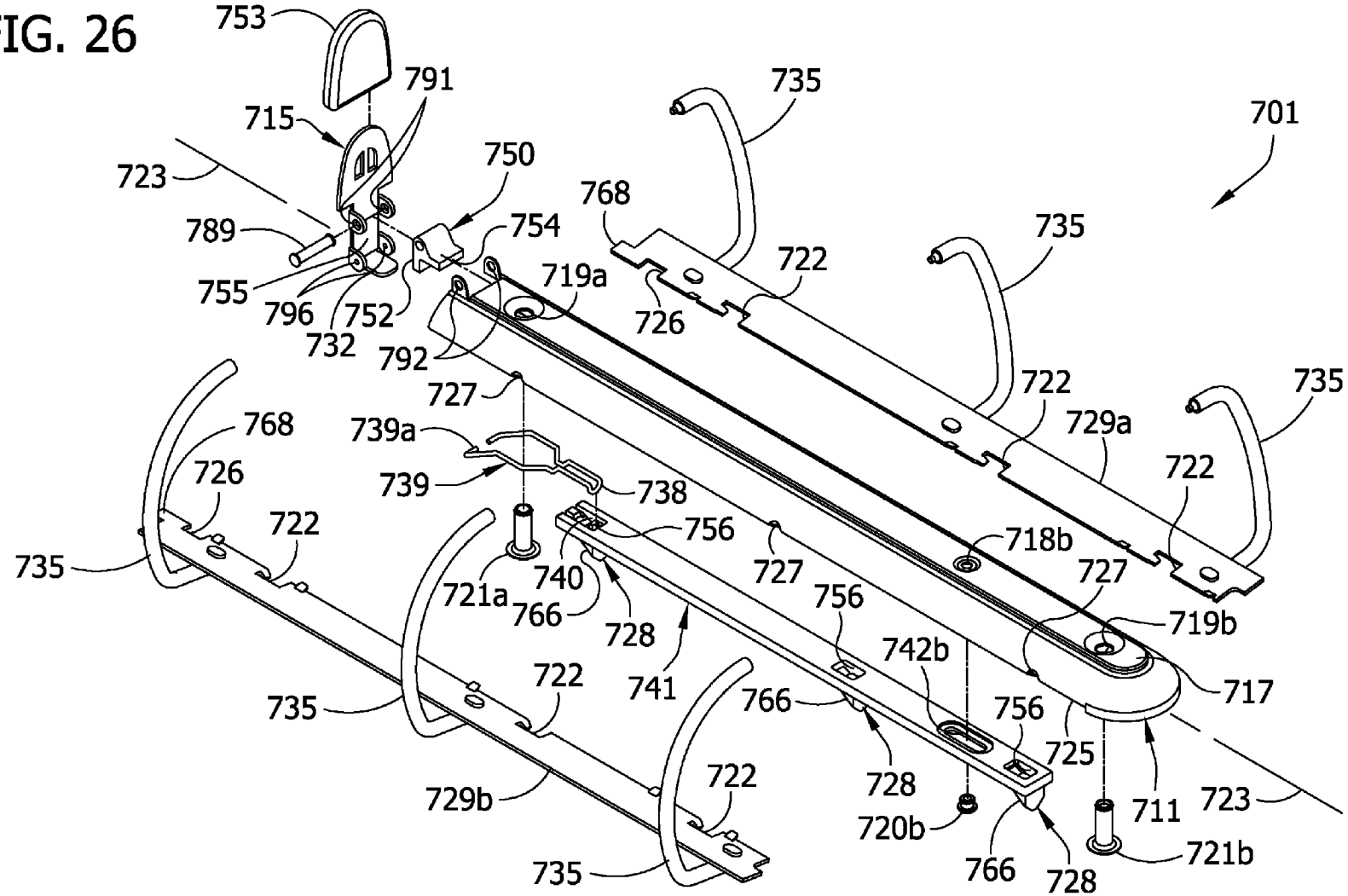
FIG. 26 is an exploded perspective of a ring binder mechanism according to an eighth embodiment of the invention.

An eighth embodiment of the ring binder mechanism of the invention is shown generally at reference numeral 701 in FIG. 26. This mechanism is substantially similar in operation and structure to the mechanism 501 of the sixth embodiment, and parts of the mechanism 701 of this embodiment corresponding to parts of the mechanism of the sixth embodiment are designated by the same reference numerals, plus "200". Blocking elements 728 are used to bias hinge plates 729*a* and 729*b* to pivot to move ring members 735 from an open position to a closed position and to block pivoting motion of the plates tending to open the ring members after they are closed. In addition in this mechanism 701, a rubber spring 750 substantially similar to that of the mechanism 201 of the third embodiment is used for urging the control structure 737 to the closed and locked position. As in the third embodiment, the rubber spring 750 is connected to the housing 711 by hinge pin 789. A first free end 752 of the rubber spring 750 engages the lever 715 while a second free end 754 engages the housing 711 at the plateau 717. Pivoting movement of the lever 715 outward and downward compresses the rubber spring 750 and moves the two ends 752 and 754 of the spring closer together. This creates a tension in the spring tending to urge the lever 715 back to the full, upright, and locked position.

The embodiments described herein are given by way of example and in no way limit the scope of the invention. For example, a torsion spring, a spring plate, and a rubber spring have been described for urging an actuating lever of a ring binder mechanism to a position in which the mechanism is locked. Other spring forms may be used without departing from the scope of the invention.

It is to be understood that the components of the ring binder mechanisms of the invention are made of a suitable rigid material, such as a metal (e.g., steel). Mechanisms with components made of non-metallic materials, specifically including a plastic, do not depart from the scope of this invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism comprising:

an elongate housing;

first and second hinge plates supported by the housing for pivoting motion relative to the housing;

rings, each including a first ring member and a second ring member, the first ring member being mounted on the first hinge plate and moveable with the pivoting motion of the first hinge plate relative to the second ring member between a closed position and an open position, in the closed position the first and second ring members form a substantially continuous closed loop, and in the open position the first and second ring members form a discontinuous open loop;

a pin secured to the housing;

an actuating lever mounted on the pin for pivoting movement relative to the housing from a first position to a second position to open the rings;

a travel bar operatively connected to the actuator so the pivoting movement of the actuator produces longitudinal movement of the travel bar relative to the hinge plates;

a blocking element secured to the travel bar for conjoint movement with the travel bar between a locking position in which the blocking element blocks pivoting movement of the hinge plates to open the rings and a non-locking position in which the blocking element does not block pivoting movement of the hinge plates to open the rings; and a torsion spring received on the pin and positioned to bias the actuating lever to its first position.

2. A ring binder mechanism as set forth in claim 1 further comprising an intermediate connector for transmitting movement of the actuator to the travel bar, the intermediate connector being connected to the actuating lever so the intermediate connector can rotate relative to the actuator and connected to the travel bar so the intermediate connector can rotate relative to the travel bar.

3. A ring binder mechanism as set forth in claim 2 wherein the intermediate connector comprises a wire.

4. A ring binder mechanism as set forth in claim 1 wherein the blocking element is in the locking position when the actuating lever is in the first position.

5. A ring binder mechanism as set forth in claim 4 wherein the spring biases the blocking element to remain in the locking position when the actuating lever is in the first position.

6. A ring binder mechanism as set forth in claim 5 wherein the blocking element is formed as one-piece with the travel bar.

7. A ring binder mechanism as set forth in claim 6 wherein the spring acts directly on the actuating lever.

8. A ring binder mechanism as set forth in claim 7 wherein the spring automatically moves the blocking element to the locking position when the rings are moved to the closed position whether or not the actuating lever is used to close the rings.

9. A ring binder mechanism as set forth in claim 7 wherein the blocking element is one of a plurality of blocking elements and each of the blocking elements moves conjointly with the travel bar.

10. A ring binder mechanism as set forth in claim 9 wherein there are at least three blocking elements.

11. A ring binder mechanism as set forth in claim 10 wherein the at least three blocking elements are formed integrally with the travel bar.

12. A ring binder mechanism as set forth in claim 1 further comprising a grooved mounting rivet, the travel bar having a slot therein, wherein the grooved mounting rivet slideable connects the travel bar to the housing and is received in the slot formed in the travel bar.

13. A ring binder mechanism as set forth in claim 1 wherein the torsion spring has a first end connected to the actuating lever for conjoint movement therewith and a second end engaging the housing.

14. A ring binder mechanism comprising:

an elongate housing;

first and second hinge plates supported by the housing for pivoting motion relative to the housing;

rings for holding the loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

a control structure supported by the housing and moveable relative to the housing between a first, closed position, and a second, open position, for use in controlling the pivoting motion of the hinge plates, the control structure including a lever having a head, a hinge pin pivotally connecting the lever to the housing for movement relative to the housing to cause movement of the control structure between said first and second positions, and a travel bar operable connected to the lever so pivoting movement of the lever produces longitudinal movement of the travel bar, the travel bar having a slot therein, a mounting rivet slideably connecting the travel bar to the housing, the mounting rivet being received in the slot in the travel bar; and a torsion spring received on the hinge pin engageable with the actuator for urging the control structure toward said first position.

15. A ring binder mechanism as set forth in claim 14 wherein the mounting rivet is a first mounting rivet and the slot in the travel bar is a first slot, the mechanism further comprising a second mounting rivet and the travel bar having a second slot therein, the second mounting rivet being spaced longitudinally from the first mounting rivet and slideably connecting the travel bar to the housing at a location spaced from the first mounting rivet, the second mounting rivet being received in the second slot in the travel bar.

16. A ring binder as set forth in claim 15 wherein the first and second mounting rivets are grooved mounting rivets.

17. A ring binder as set forth in claim 14 wherein the lever is part of an actuator, the actuator further comprising a closing arm and an opening arm, the opening and closing arms extending longitudinally from the lever on opposite sides of the hinge plates so the opening arm pivots the hinge plates when the lever is pivoted to open the rings and the closing arm pivots the hinge plates when the lever is pivoted to close the rings.

18. A ring binder mechanism comprising:

an elongate housing;

first and second hinge plates supported by the housing for pivoting motion relative to the housing;

rings for holding the loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

a pin secured to the housing;

an actuating lever mounted on the pin for pivoting movement relative to the housing on the axis of the pin from a first position to a second position to open the rings;

a travel bar operatively connected to the actuator so the pivoting movement of the actuator produces longitudinal movement of the travel bar relative to the hinge plates;

a plurality of blocking elements moveable between a locking position in which the blocking elements block pivoting movement of the hinge plates to open the rings and a non- locking position in which the blocking elements do not block pivoting movement of the hinge plates to open the rings, the blocking elements being formed integrally with the travel bar and moveable with the travel bar between the locking and unlocking positions; and a torsion spring received on the pin and positioned to bias the actuating lever to its first position 19. A ring binder mechanism as set forth in claim 18 wherein the actuator comprises an opening arm and a closing arm, the opening arm extending to a position under the hinge plates for engaging the hinge plates to pivot the hinge plates to open the rings and the closing arm extending to a position above the hinge plates for engaging the hinge plates to pivot the hinge plates to close the rings.

20. A ring binder mechanism as set forth in claim 18 wherein the blocking elements are at the bottom of the travel bar.

21. A ring binder mechanism as set forth in claim 18 further comprising rivets slideably connecting the travel bar to the housing.

22. A ring binder mechanism as set forth in claim 21 wherein the blocking elements contact the upper surface of the hinge plates in the blocking position.

23. A ring binder mechanism as set forth in claim 18 wherein the blocking elements move conjointly with the travel bar.

* * * * *